US005617197A

United States Patent [19]

Kawabata et al.

[11] Patent Number: 5,617,197

[45] Date of Patent: Apr. 1, 1997

[54] IMAGE FORMING APPARATUS HAVING A DEVICE FOR STRIPPING A TRANSFER MEMBER CARRIED ON A TRANSFER DRUM

[75] Inventors: Takashi Kawabata; Nobuo Hyakutake; Fumio Furusawa; Masaaki Tokunaga; Ryoichi Tsuruoka, all of Ebina, Japan

[73] Assignee: Fuji Xerox Co., Ltd., Tokyo, Japan

[21] Appl. No.: 570,945

[22] Filed: Dec. 12, 1995

[30] Foreign Application Priority Data

Dec. 19, 1994 [JP] Japan ..... 6-315295
Nov. 20, 1995 [JP] Japan ..... 7-301379

[51] Int. Cl.[6] ..... G03G 15/01

[52] U.S. Cl. ..... 399/398; 271/308

[58] Field of Search ..... 355/315, 271, 355/274; 271/307, 308, 311, 900

[56] References Cited

U.S. PATENT DOCUMENTS

| | | | |
|---|---|---|---|
| 4,401,382 | 8/1983 | Minejima et al. . | |
| 4,447,054 | 5/1984 | Sone | 271/311 |
| 4,748,473 | 5/1988 | Tsuruoka . | |
| 4,806,985 | 2/1989 | Foley et al. . | |
| 4,893,146 | 1/1990 | Tachibana et al. . | |
| 5,130,758 | 7/1992 | Takeda et al. | 355/315 |
| 5,138,381 | 8/1992 | Masaki et al. | 355/315.4 |
| 5,392,108 | 2/1995 | DeWaters et al. . | |

FOREIGN PATENT DOCUMENTS

| | | | |
|---|---|---|---|
| 58-97074 | 6/1983 | Japan | 355/315 |
| 1-254986 | 10/1989 | Japan . | |
| 5-61364 | 3/1993 | Japan | 355/315 |

*Primary Examiner*—Joan H. Pendegrass
*Attorney, Agent, or Firm*—Oliff & Berridge

[57] ABSTRACT

An image forming apparatus wherein a plurality of toner images having different colors from each other are successively formed on an image carrier, and the plurality of toner images formed on the image carrier are transferred to a transfer member carried on a transfer member carrier in such a condition that the plural toner images are successively overlapped with each other to thereby form an image, characterized in that the image forming apparatus comprises a pawl-shaped stripping member for stripping the transfer member from the transfer member carrier while being made in contact with a surface of the transfer member carrier at a predetermined timing; a volume electric resistance value of at least a portion of the pawl-shaped stripping member, which is made in contact with the transfer member, is selected to be greater than, or equal to 10 Ω.cm, and smaller than, or equal to $10^7$ Ω.cm; otherwise a surface electric resistance value thereof is selected to be greater than, or equal to 10 Ω/cm, or smaller than, or equal to $10^7$ Ω/cm.

13 Claims, 14 Drawing Sheets

IMAGE FORMING APPARATUS HAVING A DEVICE FOR STRIPPING A TRANSFER MEMBER CARRIED ON A TRANSFER DRUM

BACKGROUND OF THE INVENTION

The present invention relates to an image forming apparatus such as an electrophotographic copying machine and a printer, in which a plurality of toner images having different colors are successively formed on a photosensitive drum, and a plurality of toner images formed on the photosensitive drum are transferred to a transfer member carried on a transfer drum under such a condition that these plural toner images are successively overlapped with each other, to thereby form an image. More specifically, the present invention relates to a technique for stripping (exfoliating) the transfer member carried on the transfer drum.

Conventionally, as an image forming apparatus using this sort of transfer drum, there is an image forming apparatus in which a plurality of toner images having different colors such as cyan, magenta, yellow, and black are successively formed on a photosensitive drum, and then the plural toner images formed on this photosensitive drum are transferred to a transfer member such as a transfer paper carried on a transfer drum under such a condition that these toner images are successively overlapped. Then, in this image forming apparatus, after a predetermined member of toner images attracted on the transfer drum have been transferred onto the transfer member in the multiple mode, this transfer member is stripped (exfoliated) from the surface of the transfer drum, and then the toner image is fixed on the transfer member by way of a fixing device. At this time, in order to firmly strip the transfer member from the surface of the transfer drum, such a stripping (exfoliating) apparatus as a stripping finger whose tip portion is made sharp is used in this image forming apparatus.

For instance, as shown in FIGS. 19 to 21, as this stripping apparatus, the stripping finger 100 made of the plate-shaped metal member whose width is made narrow is made in contact with the transfer film 101 for forming the surface of the transfer drum at a predetermined timing, and the tip portion of the stripping finger 100 is made sharp. After the transfer member 102 is stripped from the transfer film 101 by way of the sharp tip portion of the stripping finger 100, the transfer member 102 is lift up by the upper surface of the stripping finger 100, so that the transfer member 102 is stripped from the surface of the transfer drum (disclosed in Japanese Laid-open Patent Application No. Hei. 1-254,986). Also, in the above-described stripping apparatus, to assist the stripping effects of the stripping finger 100, a plurality of stripping guide members 103 are arranged at both sides of the stripping finger 100, which may float the transfer member 102 stripped from the surface of the transfer drum by this stripping finger 100. Then, these plural strip guide members 103 are fixed to the supporting member 104 in an integral form of the stripping finger 100. This supporting member 104 is pivoted at a predetermined timing, so that the tip portion of the stripping finger 100 is made in contact with the surface of the transfer film 101.

However, in the case of the above-described conventional image forming apparatus, since a plurality of strip guide members 103 are pivoted in conjunction with the stripping finger 100, the strip guide members 103 would approach to the transfer drum up to the unwanted distance when the stripping finger 100 picks up the transfer member 102.

Therefore, when the stripping fingers 100 pick up the transfer member 102, the positions of the strip guide members 103,103, - - - , are defined to the positions for avoiding interference with the transfer drum. In other words, if the strip guide member 103 is set to the position for avoiding interference with the transfer drum when the stripping fingers 100 pick up the transfer member, the strip guide member 103 is returned to the original position after the stripping fingers 100. When the transfer member 102 is picked up by the strip guide member 103, the tip portion of the strip guide member 103 has passed the upper side of the transfer member 102, and thus this transfer member 103 is not picked up. Therefore, there is a problem that a jam happens to occur.

SUMMARY OF THE INVENTION

To solve this problem, the following solution means may be conceived. That is, there is provided a means for lowering electrostatic attracting force of the transfer member 102 with respect to the transfer film 101, and one pair of corona chargers 105*a* and 105*b* are installed at a slightly upper stream side from the point where the transfer member 102 is stripped. Then, the corona chargers eliminate static electricity, so that, the electrostatic attracting force exerted between the transfer member 102 and the transfer film 101 may be weakened. It should be noted in FIG. 20 that reference numeral 106 represents the corona discharger used to the normal stripping discharge.

However, this conventional solution means could not give satisfactory results. There is another problem that when paper with a low hardness is employed, the tip portion of the strip guide member 103 passes through the upper stream side of the transfer member 102, and therefore the transfer member 102 would not be sufficiently stripped from the transfer drum.

Therefore, to solve the above-described problem, the Applicant has proposed such an image forming apparatus as disclosed in Japanese Laid-open Patent Application No. Hei. 5-61,364. As to the stripping apparatus of the image forming apparatus according to the proposal of the Applicant, similarly, the stripping pawl made of the plate-shaped metal member with the narrow width, whose tip portion is made sharp, is employed as the stripping pawl. After the transfer member is supported by the transfer carrier on the transfer drum and then the toner image formed on the photosensitive body is transferred to the transfer member, the transfer member is stripped by the stripping apparatus of the image forming apparatus. In such an image forming apparatus, as illustrated in FIG. 22, the above-described stripping apparatus is constructed of the strip pawl 111 for partially stripping the transfer member 110; the strip guide member 112 for sequentially stripping the stripped transfer member 110 along both sides direction; and the pivot mechanism for separately pivoting the strip pawl 111 and the strip guide member 112. This stripping apparatus is so constructed that when the strip pawl 111 is located at the position to strip the transfer member 110, the strip guide member 112 is held at the position where this strip guide member 112 approaches near the transfer drum 113.

However, the above-described prior art owns the following problems. That is, in the case of the stripping apparatus in the conventional image forming apparatus, since the strip pawl 111 is made of the metal thin plate and the tip portion thereof is made sharp, when there is a change in the contact condition between the strip pawl 111 and the transfer film 113, there are such problems that the surface of the transfer film 113 would be scratched by the sharp tip portion of the strip pawl 111, and in the extremely worst case, the sharp tip portion of the strip pawl 111 would stick the transfer film 113 to thereby damage the transfer film 113.

As illustrated in FIG. 23, in order to eliminate the damages of this transfer film as much as possible, the resin roller 115 may be positioned at the lower surface of the strip pawl 111 at the tip portion. It should be noted in FIG. 23 that reference numeral 116 indicates a stripping/inner depressing member for outwardly depressing the transfer film 113 from the inside along the radial direction to thereby deform this transfer film 113 in order that the transfer member 110 can be readily stripped from the transfer film 113.

However, also in this case, when rigidness of the transfer film 113 is increased under low temperature/low humidity due to environmental variations such as temperatures and humidity, the deformation amount of the transfer film 113 is decreased, thus, there is another problem that the transfer film 113 would be damaged by the sharp tip portion of the strip pawl 111. Also, since rigidness of the transfer paper functioning as the transfer member 110 is lowered under high temperature/high humidity conditions, there is another problem that the tip portion of the strip pawl 111 would stick the paper 110. Furthermore, in such a case that an image is formed on specific paper 110 such as a double postcard with a reply card attached and a Christmas card, in which a fold is made, when the fold of the paper is stripped from the transfer film 113, there is another problem that the tip portion of the strip pawl 111 would stick the fold of this paper 110.

Also, in the case of the above-described conventional image forming apparatus, since the stripping pawl 111 is made of the metal thin plate, when a second copy surface of double-surface copy paper is stripped from the transfer drum under low temperature/low humidity conditions, the strip discharge occurs from the transfer member 110 toward the stripping pawl 111. Then, there is another problem that the toner image transferred to the tip portion on the transfer member 110 is dispersed due to this strip discharge, and thus such an image defect having a string shape located along the strip discharge would occur.

Furthermore, in the case of the above-explained conventional image forming apparatus, when the positional relationship between the strip guide member 112 and the stripping pawl 111 is slightly shifted from a predetermined position due to variations in the mounting precision and also the actuating positions about the strip guide member 112 and the stripping pawl 111, there are other problems that the stripping pawl 111 would stick the tip portion of the paper 110, the tip portion of the paper 110 would abut between the strip guide member 112 and the stripping pawl 111, and, as shown in FIG. 24, the tip portion of the paper 110 would be bent to cause a paper jam.

Therefore, the present invention has been made so as to solve the above-described conventional problems, and has an object to provide an image forming apparatus capable of preventing a transfer film from being damaged by a tip portion of a stripping pawl even when environments such as temperatures and humidity are varied in such an image forming apparatus wherein a plurality of toner images having different colors from each other are successively formed on an image carrier, and the plurality of toner images formed on the image carrier are transferred to a transfer member carried on a transfer member carrier in such a condition that the plural toner images are successively overlapped with each other to thereby form an image.

Another object of the present invention is to provide an image forming apparatus capable of avoiding such a risk that even when an image is formed on special paper such as a double postcard with a reply card attached and a Christmas card, where a fold is present, a tip portion of a stripping finger sticks the fold of the special paper.

Furthermore, another object of the present invention is to provide an image forming apparatus capable of preventing an occurrence of stripping discharge which may produce image defect in an image formed on a transfer member when a second copy surface of double-surface copy paper is stripped from a transfer drum under low temperature/low humidity.

Moreover, a further object of the present invention is to provide an image forming apparatus capable of preventing various problems even when a small variation is produced in mounting precision and activating positions of a strip guide member and a stripping finger. That is, a stripping pawl would damage a transfer member, and a paper jam happens to occur at a tip portion of the transfer member.

An image forming apparatus, according to aspect 1 of the present invention, is so arranged by that in an image forming apparatus wherein a plurality of toner images having different colors from each other are successively formed on an image carrier, and the plurality of toner images formed on the image carrier are transferred to a transfer member carried on a transfer member carrier in such a condition that the plural toner images are successively overlapped with each other to thereby form an image, the image forming apparatus comprises a pawl-shaped stripping member for stripping the transfer member from the transfer member carrier while being made in contact with a surface of the transfer member carrier at a predetermined timing; a volume electric resistance value of at least a portion of the pawl-shaped stripping member, which is made in contact with the transfer member, is selected to be greater than, or equal to 10 Ω.cm, and smaller than, or equal to $10^7$ Ω.cm; otherwise a surface electric resistance value thereof is selected to be greater than, or equal to 10 Ω/cm, or smaller than, or equal to $10^7$ Ω/cm.

Also, an image forming apparatus, according to aspect 2 of the present invention, is so arranged by that in an image forming apparatus wherein a plurality of toner images having different colors from each other are successively formed on an image carrier, and the plurality of toner images formed on the image carrier are transferred to a transfer member carried on a transfer member carrier in such a condition that the plural toner images are successively overlapped with each other to thereby form an image, the image forming apparatus comprises a pawl-shaped stripping member for stripping the transfer member from the transfer member carrier while being made in contact with a surface of the transfer member carrier at a predetermined timing; and Young's modulus of the pawl-shaped stripping member is selected to be greater than, or equal to 5 kgf/cm$^2$, and smaller than, or equal to 500,000 kgf/cm$^2$.

Further, an image forming apparatus, according to aspect 3 of the present invention, is so arranged by that in an image forming apparatus wherein a plurality of toner images having different colors from each other are successively formed on an image carrier, and the plurality of toner images formed on the image carrier are transferred to a transfer member carried on a transfer member carrier in such a condition that the plural toner images are successively overlapped with each other to thereby form an image, the image forming apparatus comprises a pawl-shaped stripping member for stripping the transfer member from the transfer member carrier while being made in contact with a surface of the transfer member carrier at a predetermined timing, the pawl-shaped stripping member having a sectional view of a substantially wedge shape; a tip shape of the pawl-shaped stripping member, which is made in contact with the transfer member, is made in such a manner that a width of the tip shape is widened along with the advancing direction of the transfer member after being stripped; a tip portion of the pawl-shaped stripping member is made in a straight-line shape or a curved-line shape along the axial direction of the transfer member carrier; and a portion of the pawl-shaped stripping member, which is made in contact with the surface of the transfer member carrier after the transfer member has been stripped, is made in a plane shape.

In addition, an image forming apparatus, according to aspect 4 of the present invention, is so arranged by that in an image forming apparatus wherein a plurality of toner images having different colors from each other are successively formed on an image carrier, and the plurality of toner images formed on the image carrier are transferred to a transfer member carried on a transfer member carrier in such a condition that the plural toner images are successively overlapped with each other to thereby form an image, the image forming apparatus comprises a pawl-shaped stripping member for stripping the transfer member from the transfer member carrier while being made in contact with a surface of the transfer member carrier at a predetermined timing, the pawl-shaped stripping member having a sectional view of a substantially wedge shape; a tip shape of the pawl-shaped stripping member, which is made in contact with the transfer member, is made in such a manner that a width of the tip shape is widened along with the advancing direction of the transfer member after being stripped; a tip portion of the pawl-shaped stripping member is made in a straight-line shape; and a portion of the pawl-shaped stripping member, which is made in contact with the transfer member after the transfer member has been stripped, is constructed of a first very small plane, the contact angle of which is relatively large with respect to the transfer member carrier made firstly in contact with at least a rear surface of the transfer member, and a second plane, the contact angle of which is relatively small with respect to the transfer member carrier formed subsequent to the first plane.

Furthermore, an image forming apparatus, according to aspect 5 of the present invention, is so arranged by that in an image forming apparatus in any one of the preceding aspects 1 to 4, a friction coefficient of the transfer member contact surface of the pawl-shaped stripping member with respect to the transfer member is selected to be smaller than, or equal to 1.

Moreover, an image forming apparatus, according to aspect 6 of the present invention, is so arranged by that in an image forming apparatus in any one of the preceding aspects 1 to 4, a surface roughness of the transfer member contact surface of the pawl-shaped stripping member is selected to be lower than, or equal to 20 μm.

Also, an image forming apparatus, according to aspect 7 of the present invention, is so arranged by that in an image forming apparatus in any one of the preceding aspects 1 to 6, the image forming apparatus comprises a strip guide member arranged at least near the pawl-shaped stripping member and along the axial direction of the transfer member carrier under non-contact condition with the surface of the transfer member carrier, for supporting the stripping effect of the pawl-shaped stripping member; and both of the transfer member contact surface of the pawl-shaped striping member and a transfer member contact surface of the strip guide member constitute the substantially same plane when the pawl-shaped stripping member is under stripping condition.

It should be noted that the above-described pawl-shaped stripping member may be formed by, for instance, an elastic member.

In the image forming apparatus according to aspect 1 of the present invention, since the image forming apparatus comprises a pawl-shaped stripping member for stripping the transfer member from the transfer member carrier while being made in contact with a surface of the transfer member carrier at a predetermined timing; the volume electric resistance value of at least a portion of the pawl-shaped stripping member, which is made in contact with the transfer member, is selected to be smaller than, or equal to $10^7$ Ω.cm; otherwise the surface electric resistance value thereof is selected to be smaller than, or equal to $10^7$ Ω/cm, even if at least the portion of the pawl-shaped stripping member, which is made in contact with the transfer member, is made of an insulating material, the resistance value is relatively small. Thus, when the transfer member is stripped from the surface of the transfer member carrier by way of the pawl-shaped stripping member, it is possible to avoid, or suppress such a fact that the stripping discharge is produced from the transfer member toward the pawl-shaped stripping member. Even when the charging amounts of the transfer member are large under low temperature/low humidity condition, and the second copy surface of the double-surface copy paper, it is possible to avoid that the image defect is caused by the stripping discharge.

Moreover, in this image forming apparatus according to aspect 1 of the present invention, since the volume electric resistance value of at least a portion of the pawl-shaped stripping member, which is made in contact with the transfer member, is selected to be greater than, or equal to 10 Ω.cm, otherwise the surface electric resistance value thereof is selected to be greater than, or equal to 10 Ω/cm, even when the transfer member is such paper containing higher humidity under high temperature/high humidity environments, it is possible to avoid such a fact that the transfer current is leaked through the transfer member constructed of the paper containing the high humidity whose resistance becomes low to the pawl-shaped stripping member, resulting in insufficient transfer operation. This transfer current is used to transfer the toner image from the image carrier to the transfer member held on the transfer member carrier.

In the image forming apparatus according to aspect 2 of the present invention, since the image forming apparatus comprises a pawl-shaped stripping member for stripping the transfer member from the transfer member carrier while being made in contact with a surface of the transfer member carrier at a predetermined timing; and Young's modulus of the pawl-shaped stripping member is selected to be greater than, or equal to 5 kgf/cm$^2$, and smaller than, or equal to 500,000 kgf/cm$^2$, there is no such an insufficient transfer operation caused by deformation of the pawl-shaped stripping member as the pawl-shaped stripping member whose Young's modulus is below 5 kgf/cm$^2$. Moreover, there is no risk that such a pawl-shaped stripping member whose Young's modulus exceeds 500,000 kgf/cm$^2$sticks the transfer film for constituting the transfer member carrier to thereby damage this transfer film.

Furthermore, in the image forming apparatus according to aspect 3 of the present invention, the image forming apparatus comprises a pawl-shaped stripping member for stripping the transfer member from the transfer member carrier while being made in contact with a surface of the transfer member carrier at a predetermined timing, the pawl-shaped stripping member having a sectional view of a substantially wedge shape; the tip shape of the pawl-shaped stripping member, which is made in contact with the transfer member, is made in such a manner that a width of the tip shape is widened along with the advancing direction of the transfer member after being stripped; the tip portion of the pawl-shaped stripping member is made in a straight-line shape or a curved-line shape along the axial direction of the transfer member carrier; and the portion of the pawl-shaped stripping member, which is made in contact with the surface of the transfer member carrier after the transfer member has been stripped, is made in a plane shape. Accordingly, even when the image forming apparatus is so arranged that the substantially wedge shape corresponding to the sectional view of the pawl-shaped stripping member is made thick in order to prevent the surface of the transfer member carrier from being damaged by the tip portion of the pawl-shaped stripping member, the transfer member can be firmly stripped at the initial stage by the tip portion of the pawl-shaped stripping member formed in either the straight-line shape, or the curved-line shape along the axial direction of the transfer member carrier. Thereafter, the width of the pawl-shaped stripping member is made wide along the advancing direction of the stripped transfer member, and also the transfer member is smoothly picked up from the transfer member carrier by the plane-shaped portion of the pawl-shaped stripping member which is made in contact with the transfer member after being stripped. Therefore, the transfer member can be firmly stripped.

In addition, in the image forming apparatus according to aspect 4 of the present invention, the image forming apparatus comprises a pawl-shaped stripping member for stripping the transfer member from the transfer member carrier while being made in contact with a surface of the transfer member carrier at a predetermined timing, the pawl-shaped stripping member having a sectional view of a substantially wedge shape; the tip shape of the pawl-shaped stripping member, which is made in contact with the transfer member, is made in such a manner that a width of the tip shape is widened along with the advancing direction of the transfer member after being stripped; the tip portion of the pawl-shaped stripping member is made in a straight-line shape; and a portion of the pawl-shaped stripping member, which is made in contact with the transfer member after the transfer member has been stripped, is constructed of the first very small plane, the contact angle of which is relatively large with respect to the transfer member carrier made firstly in contact with at least the rear surface of the transfer member, and the second plane, the contact angle of which is relatively small with respect to the transfer member carrier formed subsequent to the first plane. Even if such a special paper as a double postcard with a reply card attached and a Christmas card, in which a fold is present, is employed, when the fold of this special paper is stripped from the transfer member carrier, the fold of the special paper is raised by the first very small plane whose contact angle is relatively large with respect to the transfer member carrier which is firstly made in contact with the rear surface of the transfer member. Thus, since the fold of the special paper is stripped from the surface of the transfer member carrier at the second plane by way of the hardness of the paper, it is surely possible to avoid such a fact that the tip portion of the pawl-shaped stripping member sticks the fold of the paper.

It should be understood that when the above-described pawl-shaped stripping member is fabricated by the elastic member, if the pawl-shaped stripping member is made in contact with the transfer member carrier under excessive pressure, then the tip portion of the pawl-shaped stripping member is elastically deformed. As a consequence, it is possible to prevent the transfer carrier and the transfer member from being prevented.

Furthermore, the image forming apparatus according to aspect 5 of the present invention is so arranged by that in the image forming apparatus in any one of aspects 1 and 4, the friction coefficient of the transfer member contact surface of the pawl-shaped stripping member with respect to the transfer member is selected to be smaller than, or equal to 1. Since after the transfer member has been stripped from the transfer member carrier, the tip portion of the transfer member is guided by the transfer member contact surface of the pawl-shaped stripping member having the low friction coefficient, it is possible to prevent the occupance of the paper jam at the tip portion of the transfer member.

Moreover, the image forming apparatus according to aspect 6 of the present invention is so arranged by that in the image forming apparatus in any one of the aspects 1 to 4, the surface roughness of the transfer member contact surface of the pawl-shaped stripping member is selected to be lower than, or equal to 20 μm. Since after the transfer member has been stripped from the transfer member carrier, the tip portion of the transfer member is guided by the transfer member contact surface of the pawl-shaped stripping member whose surface roughness is low, it is possible to prevent the occurrence of the paper jam at the tip portion of the transfer member.

Also, in the image forming apparatus according to aspect 7 of the present invention is so arranged by that in the image forming apparatus in any one of the aspects 1 to 6, the image forming apparatus comprises a strip guide member arranged at least near the pawl-shaped stripping member and along the axial direction of the transfer member carrier under non-contact condition with the surface of the transfer member carrier, for supporting the stripping effect of the pawl-shaped stripping member; and both of the transfer member contact surface of the pawl-shaped striping member and a transfer member contact surface of the strip guide member constitute the substantially same plane when the pawl-shaped stripping member is under stripping condition. As a consequence, after the transfer member has been stripped from the transfer member carrier, the substantially same plane thereof is guided by the transfer member contact surface of the pawl-shaped stripping member and the transfer member contact surface of the stripping guide member, so that it is possible to prevent the occurrence of the paper jam at the tip portion of the transfer member.

DETAILED DESCRIPTION OF THE PREFERRED EMBODIMENTS

The present invention will now be described based upon embodiments shown in drawings.

Figure 5:
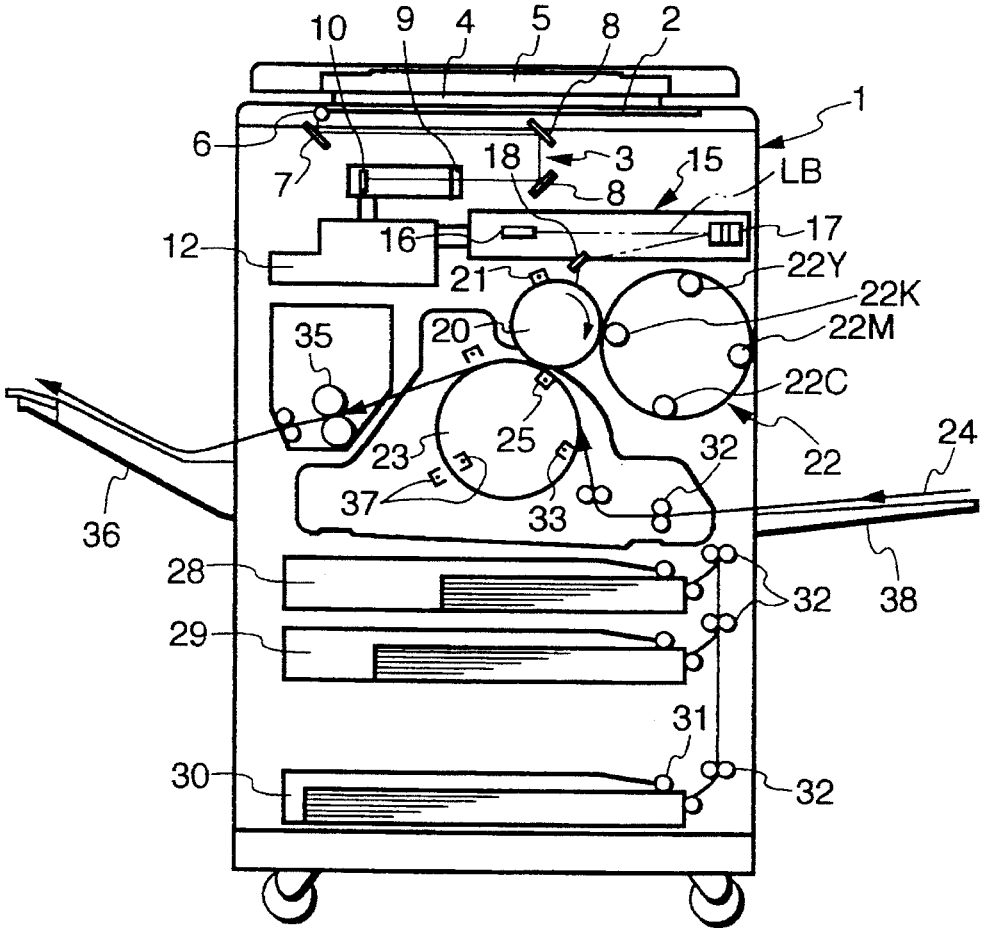
FIG. 5 is a structural diagram for showing an image forming apparatus according to an embodiment of the present invention.

In FIG. 5, there is represented a multi-transfer type digital color image forming apparatus functioning as an image forming apparatus according to the present invention.

In FIG. 5, reference numeral 1 indicates a main body of the digital color image forming apparatus. An image reading apparatus 3 (Image Input Terminal) for reading an image of an original 2 is arranged at an upper edge portion within the main body 1 of this digital color image forming apparatus. In this image input terminal 3, the image of the original 2 positioned on platen glass 4 under such a condition that this original 8 is depressed by a platen cover 5 is illuminated by a light source 6, an image optically reflected from the original 2 is exposed via a first scanning mirror 7 and a second scanning mirror 8 and also an imaging lens 9 onto a CCD sensor 10 so as to be optically scanned, and then a color material reflection light image of the original 2 is read by this CCD sensor 10 in a predetermined dot density (for instance, 16 dots/mm).

The color material reflection light image of the original 2 read by the image input terminal 3 is transmitted as, for instance, three colors (red, green, blue) original reflectivity data (8 bits/color) to an image processing apparatus 12 (Image Processing System). In this image processing system 12, predetermined image processing operations are carried out with respect to the reflectivity data of the original 2, for instance, a shading correction, a positional shift correction, a lightness/color space conversion, a gamma correction, a frame erasing, and a color/movement editing.

Then, as described above, the image data to which the predetermined image process operations have been performed in the image processing system 12 are converted into three colors original color material gradation data of black (K), yellow (Y), magenta (M), and cyan (C) (8 bits/ color), which are supplied to an ROS 15 (Raster Output Scanner). In this ROS 15, the images are exposed by the laser light in response to the original color material gradation data.

As indicated in FIG. 5, the ROS 15 modulates a semiconductor laser 16 in response to the original color material gradation data 14, and emits the laser light LB from this semiconductor laser 16 in response to the gradation data 14. The laser light LB emitted from this semiconductor laser 16 is polarized/scanned by way of a rotary polygon mirror 17, and is scanned/exposed via a reflection mirror 18 onto a photosensitive drum 20.

The photosensitive drum 20 on which the laser light LB is scanned/exposed by the ROS 15 is rotated by a drive means (not shown) at a predetermined speed along an arrowed direction. After the surface of this photosensitive drum 20 is previously charged by a charge corotron 21 to a predetermined potential, the laser light LB is scanned/exposed on the surface of the photosensitive drum 20 in response to the original color material gradation data, so that an electrostatic latent image is formed thereon. The electrostatic latent image formed on the photosensitive drum 20 is successively developed by a rotary type developing apparatus 22 equipped with four color developers 22K, 22Y, 22M and 22C in black (K), yellow (Y), magenta (M), and cyan (C), so that the developed latent image becomes a toner image having a predetermined color.

Figure 25:
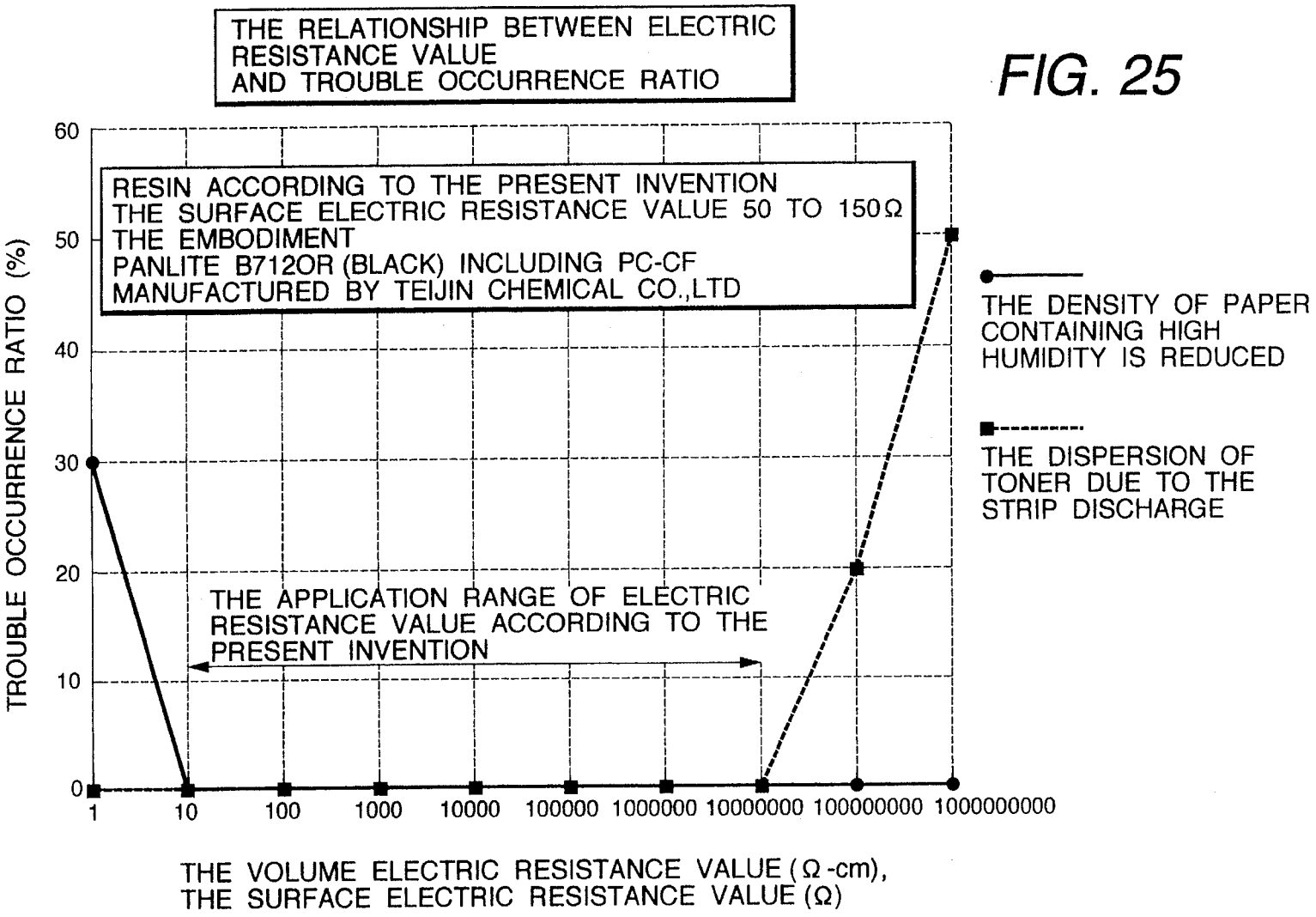
FIG. 25 is a graphic representation for showing a relationship between the resistance value of the strip finger and the trouble occurrence ratio.

The toner image formed on the photosensitive drum 20 is successively transferred by being charged by a transfer corotron 25 onto transfer paper 24 held as a transfer member on a transfer drum 23 arranged adjacent to this photosensitive drum 20. As illustrated in FIG. 25, the transfer member (paper) 24 is supplied by a paper supply roll 31 from a plurality of paper supply cassettes 28, 29, 30 positioned at the lower portion of the main body 1 of the image forming apparatus. Also, the transfer member (paper) may be supplied from a hand delivery tray 38 arranged at the side surface outside the main body 1 of the image forming apparatus. The supplied transfer member 24 is transported up to the surface of the transfer drum 24 by a transport roller 32. Then, the transfer member 24 is held at the surface of the transfer drum 23 under such a condition that this transfer member 24 is electrostatically absorbed on the surface of the transfer drum 24 by way of the charging effect of the charge corotron 33. It should be noted that a transparent OHP sheet used in an overhead projector, other than the transfer paper having the irregular paper sizes, may be supplied by the hand delivery tray 38 to thereby form an image on the OHP sheet and the like. Also, the transfer member 24 where the image has been made on one surface is turned over to be supplied from the hand delivery tray 38, so that a double-surface copy may be produced.

Then, the transfer member 24 to which the toner image having a predetermined member of color has been transferred from the photosensitive drum 20 is stripped from the surface of the transfer drum 23 by the charging operation of the strip corotron 34, and thereafter the stripped transfer member 24 is transported to a fixing device 35. The toner image is fixed on the transfer member 24 by way of thermal and pressure effects by this fixing device 35, and the toner-image-fixed transfer member 24 is ejected onto a paper ejection tray 36, so that the color image forming stage is accomplished.

It should be noted that reference numeral 37 shown in FIG. 5 indicates a charge exfoliating corotron for exfoliating the charge of the transfer drum 23.

Figure 6:
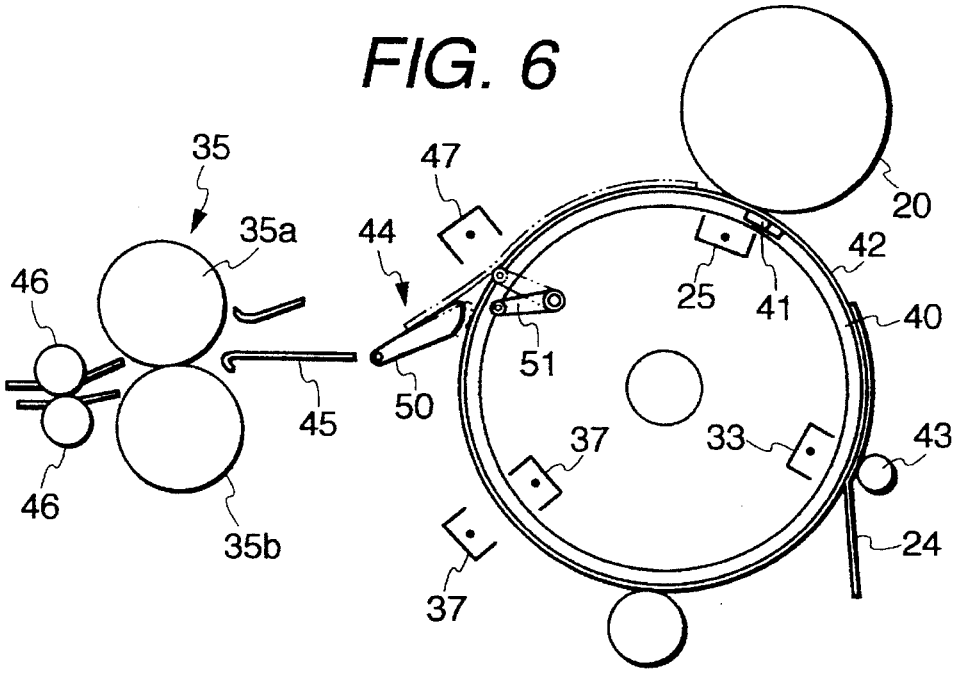
FIG. 6 is a structural diagram for indicating an image forming unit of the image forming apparatus according to an embodiment of the present invention.

FIG. 6 schematically shows an image forming unit of the above-described multi-transfer type digital color image forming apparatus.

In FIG. 6, reference numeral 20 indicates the above-described photosensitive drum. The transfer drum 23 functioning as the transfer member carrier is arranged in such a manner that this transfer drum 23 is made in contact with the surface of the photosensitive drum 20. The transfer drum 23 is rotationally driven by a drive mechanism (not shown) at the same speed as the peripheral (circumferential) speed of the photosensitive drum 20. This transfer drum 23 is comprised of a drum-shaped frame body having ring members 40 and 40 as one pair of toroidal members arranged at both edge portions along the axial direction, and a tie-bar plate 41 as a coupling member for mutually coupling these members 40 and 40. A tip portion of the transfer film 42 made of such a dielectric film as polyethylene terephthalate and polyvinylidene fluoride, along the circumferential direction, is fixed on the tie-bar plate 41. Also, the edge portions at both sides of this transfer film 42 are wound on the frame body along the outer peripheral surfaces of the ring members 40 and 40, and also the rear edge portion of this transfer film 42 along the circumferential direction is fixed on the tie-bar plate 41 to thereby form a hollow cylindrical shape.

As explained above, the transfer member 24 is supplied from any one of the plural paper supply cassettes 28, 29, 30 to the transfer drum 23. This transfer member 24 is depressed on the surface of the transfer drum 23 by an adsorption roller 43, and this surface of the transfer drum 23 is charged from its rear side by an adsorption corotron 33, so that the transfer member 24 is electrostatically adsorbed on the transfer film 42 of the transfer drum 23. The toner images of black (K), yellow (Y), magenta (M), and cyan (C) which are successively formed on the photosensitive drum 20 are transferred by way of the charging effect of the transfer corotron 25 to the transfer member 24 adsorbed on this transfer drum 23.

Then, after the transfer member 24 to which the toner images having a predetermined number of color have been transferred from the photosensitive drum 20 is stripped from the surface of the transfer drum 23 by the stripping apparatus 44, this transfer member 24 is transported via a transport guide 45 to the fixing device 35. The toner image is fixed on the transfer member 24 by way of the thermal and pressure effects by using a fixing roller **35*a* and a pressure roller 35*b*, and the toner-image-fixed transfer member 24 is ejected by a fuser exit roll 46 onto the eject paper tray 36** provided outside the image forming apparatus.

On the other hand, according to this embodiment, it is so constructed that the image forming apparatus comprises a pawl-shaped stripping member for stripping the transfer member from the transfer member carrier while being made in contact with a surface of the transfer member carrier at a predetermined timing, the pawl-shaped stripping member having a sectional view of a substantially wedge shape; a tip shape of the pawl-shaped stripping member, which is made in contact with the transfer member, is made in such a manner that a width of the tip shape is widened along with the advancing direction of the transfer member after being stripped; a tip portion of the pawl-shaped stripping member is made in a straight-line shape or a curved-line shape along the axial direction of the transfer member carrier; and a portion of the pawl-shaped stripping member, which is made in contact with the surface of the transfer member carrier after the transfer member has been stripped, is made in a plane shape.

In other words, as illustrated in FIG. 6, a strip finger 50 is positioned in such a manner that this strip finger 50 is made in contact with the surface of the transfer drum 23 at a predetermined timing. Also, a stripping inner depression member 51 is positioned within the transfer drum 23 in such a way that the transfer film 42 is depressed at a predetermined timing from the inside thereof to the outside thereof along the radial direction by this stripping inner depression member 51 so as to deform this transfer film 42, whereby the transfer member 24 can be readily stripped. At the upper stream side of the strip finger 50 of the transfer drum 23, a strip corotron 47 is provided which exfoliate the electric charge on the transfer member 24, so that this transfer member 24 can be easily stripped. The strip finger 50 is made of, for example, either engineer plastic such as a polycarbonate, or an elastic member such as hard rubber. The volume electric resistance value of this strip finger 50 is set to be larger than, or equal to 10 Ω.cm, and be smaller than, or equal to $10^7$ Ω.cm. Also, the surface electric resistance value per unit length of the string finger 50 is selected to be greater than, or equal to 10 Ω/cm, and be smaller than, or equal to $10^7$ Ω/cm. The strip finger 50 may be made of metal. In this embodiment, the strip finger 50 is made of polycarbonate (manufactured by Teijin Chemical Co., Ltd as tradename of "PANLITE B7120R"), whose surface electric resistance value per unit length is selected to be $3.0\times10^2$ Ω/cm. It should be noted that all of the above-described strip finger 50 need not be set to the following conditions. That is, the volume electric resistance values of these strip fingers are not required to be larger than, or equal to 10 Ω.cm, and be smaller than, or equal to $10^7$ Ω.cm, otherwise the surface electric resistance values per unit lengths thereof are not required to be larger than, or equal to 10 Ω/cm, and be smaller than $10^7$ Ω/cm. However, the electric resistance values about at least such a portion of the strip finger 50, which is made in contact with the transfer member, may be set as follows by constructing the portion in contact with this transfer member by either the conductive material, or the metal. That is, the volume electric resistance value is selected to be greater than, or equal to 10 Ω.cm, and be smaller than, or equal to $10^7$ Ω.cm, and also the surface electric resistance value per unit length is selected to larger than, or equal to 10 Ω/cm, and be smaller than, or equal to $10^7$ Ω/cm. The adjustments in the electric resistance values about at least the portion of such a strip finger, which is in contact with the transfer member, are carried out by filling the conductive material of carbon into the synthetic resin such as polycarbonate for constituting the strip finger.

In this embodiment, the Young's modulus of the above-described strip finger 50 is set to be higher than, or equal 5 kgf/cm$^2$ and lower than, or equal to 500,000 kgf/cm$^2$. As described above, as this strip finger 50, such a strip finger is employed which is made of polycarbonate (manufactured by Teijin Chemical Co., Ltd and tradename of "PANLITE B7120R") into which a carbon fiber is filled. The Young's modulus of this strip finger 50 made of polycarbonate is selected to be 20,000 kgf/cm$^2$. As the material of the strip finger 50, thermosetting polyurethane (manufactured by Hokushin Industry Co., Ltd and tradename of "#238707", Young's modulus E=57 kgf/cm$^2$), PC (polycarbonate) (Young's modulus E=23,000 kgf/cm$^2$), or PET (polyethylene terephthalate) (Young's modulus E=4,000 kgf/cm$^2$) may be utilized. It should be noted that the Young's modulus "E" of aluminum is equal to 630,000 kgf/cm$^2$ and the Young's modulus "E" of the sheet metal as the material of the conventional strip finger is equal to 2,100,000 kgf/cm$^2$.

Figure 1A:
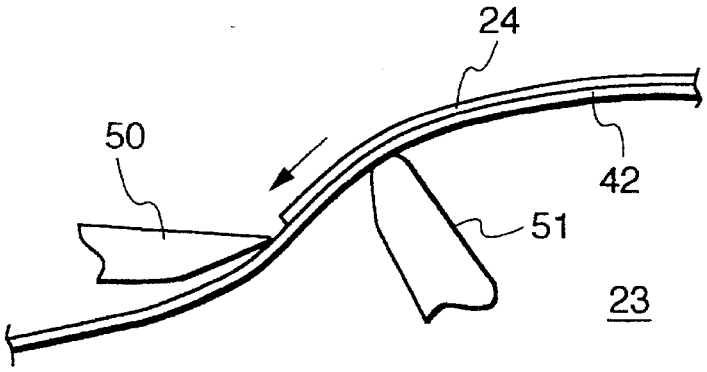
FIGS. 1A and 1B are sectional structural diagrams for showing a major portion of a stripping apparatus of an image forming apparatus according to an embodiment of the present invention.
Figure 1B:
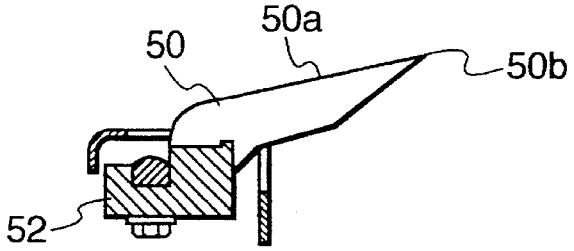
Figure 2:
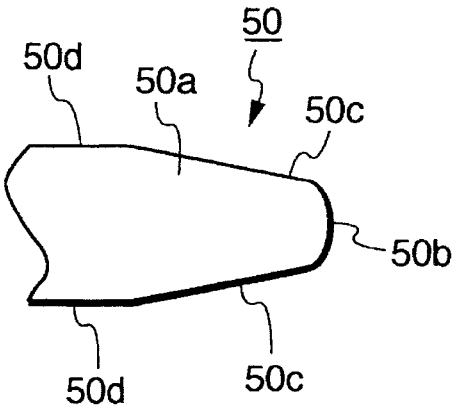
FIG. 2 is a plan view for indicating a tip portion of a strip finger.
Figure 3A:
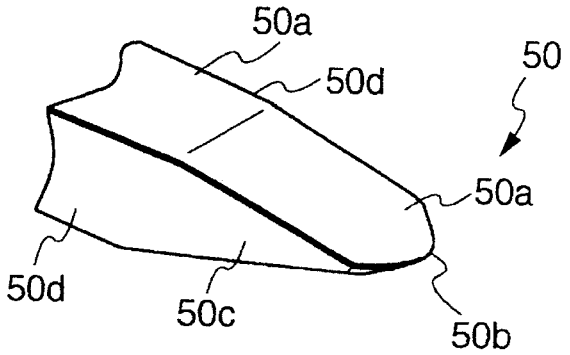
FIG. 3A and 3B is a perspective view for showing the strip finger.
Figure 3B:
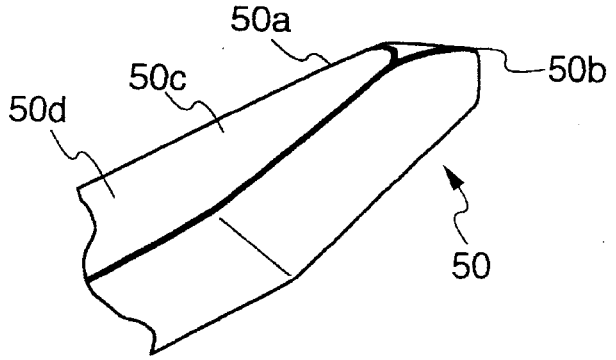

As shown in FIG. 1, the width of the above-described strip finger 50 is made wide and in a substantially wedge shape, as viewed in a sectional view thereof, and an upper edge surface 50*a* thereof is made flat. Furthermore, a tip portion 50*b* of the strip finger 50 is made in a knife edge shape with a relatively large angle, as viewed in a sectional view thereof. A rear edge portion of this strip finger 50 from an intermediate portion thereof is so arranged that this rear edge portion is located substantially parallel to the upper edge surface 50*a*, and is made thick. As represented in FIG. 2, and FIG. 3, the tip portion 50*b* of the strip finger 50 is made in an arc shape along the shaft direction of the transfer drum 23, and also a side edge portion 50*c* of this strip finger 50, which is made in contact with the transfer paper, has a taper-shaped width widened along the advancing direction of the stripped transfer member 24. A portion of this strip finger 50 after the intermediate portion has a relatively wide width, and both-side edge portions 50*d* thereof are located in parallel to each other. As a result, a portion of the strip finger 50, which is made in contact with the stripped transfer member 24, namely the upper edge surface 50*a* of the strip finger is made in a plane shape, as explained before.

Furthermore, the coefficient of friction of the upper edge surface 50*a* of the strip finger 50, which is made in contact with the transfer member 24, is designed to be lower than, or equal to 1 with respect to the transfer member 24. The method for measuring this friction coefficient is regulated based upon ASTM D-1894-78. It should be noted that the surface roughness of the upper edge surface 50*a* of the strip finger 50, which is made in contact with the transfer member 24, may be designed to be smaller than, or equal to 20 μm, other than the coefficient of friction. The method for measuring this surface roughness is regulated based upon JIS B0601.

As previously described, the strip finger 50 is so constructed, as shown in FIG. 1, that a base edge portion 50*e* thereof is fixed to a pivot shaft 52 which is rotatably supported by front and rear frames of the image forming apparatus, and this pivot shaft 52 is pivoted at a predetermined timing, so that the tip portion 50*b* of the strip finger 50 abuts against the surface of the transfer drum 23.

Figure 4A:
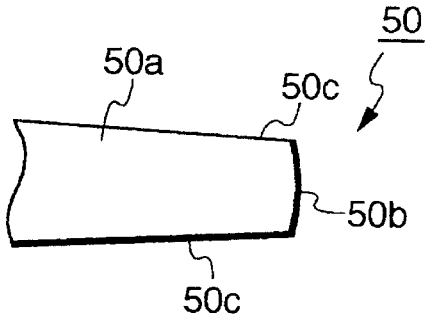
FIGS. 4A to 4C are plan views for representing modified embodiments of the strip finger.
Figure 4B:
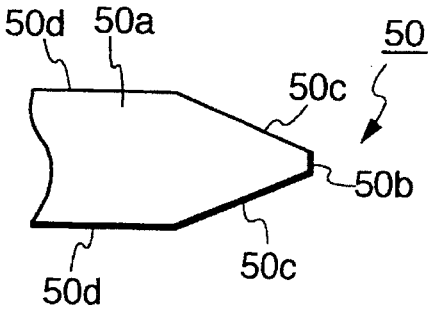
Figure 4C:
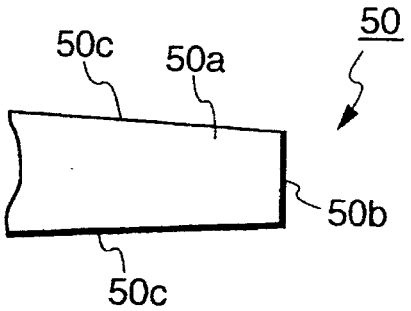

FIGS. 4A to 4C represent modified examples for the shape of the tip portion of the above-described strip finger. The strip finger 50 shown in FIG. 4A is so constructed that the tip portion 50*b* thereof is made in an arc shape having a large curvature along the shaft direction of the transfer drum 23, the side edge portion 50*c* of this strip finger which is made in contact with the transfer paper has a taper shape with a width gradually widened along the advancing direction of the stripped transfer paper, and the width is widened in a gentle gradient over the rear edge portion. It should be understood that the gradients of the both side portions of this strip finger 50 are not always made equal, but the gradient of the lower-side edge portion 50*c* may be made smaller than that of the upper-side edge portion 50*a*, as shown in this drawing.

Also, the strip finger 50 indicated in FIG. 4B is so fabricated that the tip portion 50*b* thereof is made in a straight line shape with a narrow width along the shaft direction of the transfer drum 23, the side edge portion 50*c* of this strip finger 50 which is made in contact with the transfer paper is made in a taper shape with a width rapidly widened along the advancing direction of the stripped transfer paper 23, and a portion of this strip finger 50 after the intermediate portion thereof has a relatively wide width whose both side edge portions are located in parallel to each other.

Moreover, the strip finger 50 shown in FIG. 4C is so constructed that the tip portion 50*b* thereof is made in a straight line shape along the shaft direction of the transfer drum 23, the side edge portion 50*c* of this strip finger which is made i contact with the transfer paper has a taper shape with a width gradually widened along the advancing direction of the stripped transfer paper, and the width is widened in a gentle gradient over the rear edge portion. It should be understood that the gradients of the both side portions of this strip finger 50 are not always made equal, but the gradient of the lower-side edge portion 50*c* may be made smaller than that of the upper-side edge portion 50*a*, as shown in this drawing.

Similar to the strip finger 50 indicated in FIG. 2 and FIG. 4B, the gradients of the both side edge portions 50*c* and 50*c* are not always made equal to each other, but the gradient of one side edge portion 50*c* may be made different from that of the other side edge portion 50*c*.

In accordance with the image forming apparatus with the above-described structure according to this embodiment, in such an image forming apparatus wherein a plurality of toner images having different colors from each other are successively formed on an image carrier, and the plurality of toner images formed on the image carrier are transferred to a transfer member carried on a transfer member carrier in such a condition that the plural toner images are successively overlapped with each other to thereby form an image, even when the environments such as the temperatures and the humidity are varied, the damages of the transfer film caused by the tip portion of the stripping pawl can be prevented.

In other words, in the image forming apparatus according to this embodiment, as shown in FIG. 6, after the toner images colored in black (K), yellow (Y), magenta (M), and cyan (C) sequentially formed on the photosensitive drum 20 are sequentially transferred in the multi mode on the transfer member 24 adsorbed on the transfer drum 23 in conjunction with the rotations of this transfer drum 23, the transfer member 24 to which the toner image having a predetermined number of color has been transferred is stripped from the surface of the transfer drum 23 by the stripping apparatus 44 and then is processed by the fixing device 35 in the fixing process operation.

At this time, as illustrated in FIG. 6, the strip finger 50 of the stripping apparatus 44 is made in contact with the transfer film 42 forming the surface of the transfer drum 23 under pressure condition by pivoting the pivot shaft 52 by a drive means (not shown), and also the transfer film 42 is depressed at a predetermined timing from the inside to the outside thereof along the radial direction by the stripping inner depression member 51 arranged inside the transfer drum 23 in order to thereby deform this transfer film 42.

Figure 7A:
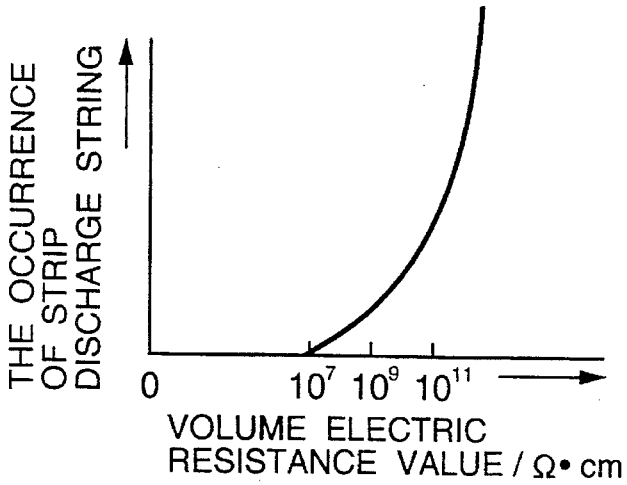
FIGS. 7A and 7B are graphic representations for indicating a relationship between the volume electric resistance value of the strip finger and the occurrence ratio of stripping discharge, and for representing a relationship between the friction coefficient of the paper contact surface of the strip finger with respect to the paper and the occurrence ration of strip failure.

On the other hand, according to this embodiment, since the volume electric resistance value of the strip finger 50 is set to be lower than $10^7$ Ω.cm, or the surface electric resistance value per unit length is lower than $10^7$ Ω/cm, even when at least the portion of the strip finger 50 which is made in contact with the transfer member 24 represents the insulating characteristic, the resistance value thereof is relatively low. When the transfer member 24 is stripped from the surface of the transfer drum 23 by the strip finger 50, the charged electrons owned by the transfer member 24 can be effectively passed to the strip finger 50, so that it is possible to avoid, or suppress such a risk that the strip discharge occurs from the transfer member 24 to the strip finger 50. As previously confirmed by the experiments performed by the Inventors of the present invention, even when the charge amount of the transfer member 24 is large as in the second copy surface of the double-surface copy paper and under the low temperature/low humidity condition, as shown in FIG. 7A and FIG. 25, it is possible to prevent the image defect from being produced by the strip discharge operation.

Moreover, in the image forming apparatus according to this embodiment, since the volume electric resistance value of the strip finger 50 is selected to be greater than, or equal to 10 Ω.cm, otherwise, the surface electric resistance value per unit length thereof is selected to be greater than, or equal to 10 Ω/cm, as confirmed by the experiments effected by the Inventors of the present invention, even when the transfer member 24 is such paper containing high humidity under high temperature/high humidity environment, as shown in FIG. 25, it is possible to avoid such a problem that the transfer current is leaked via the strip finger 50 to cause the insufficient transfer operation to occur, and the transfer current is used to transfer the toner image to the transfer member 24 held on the transfer drum 23.

Figure 26:
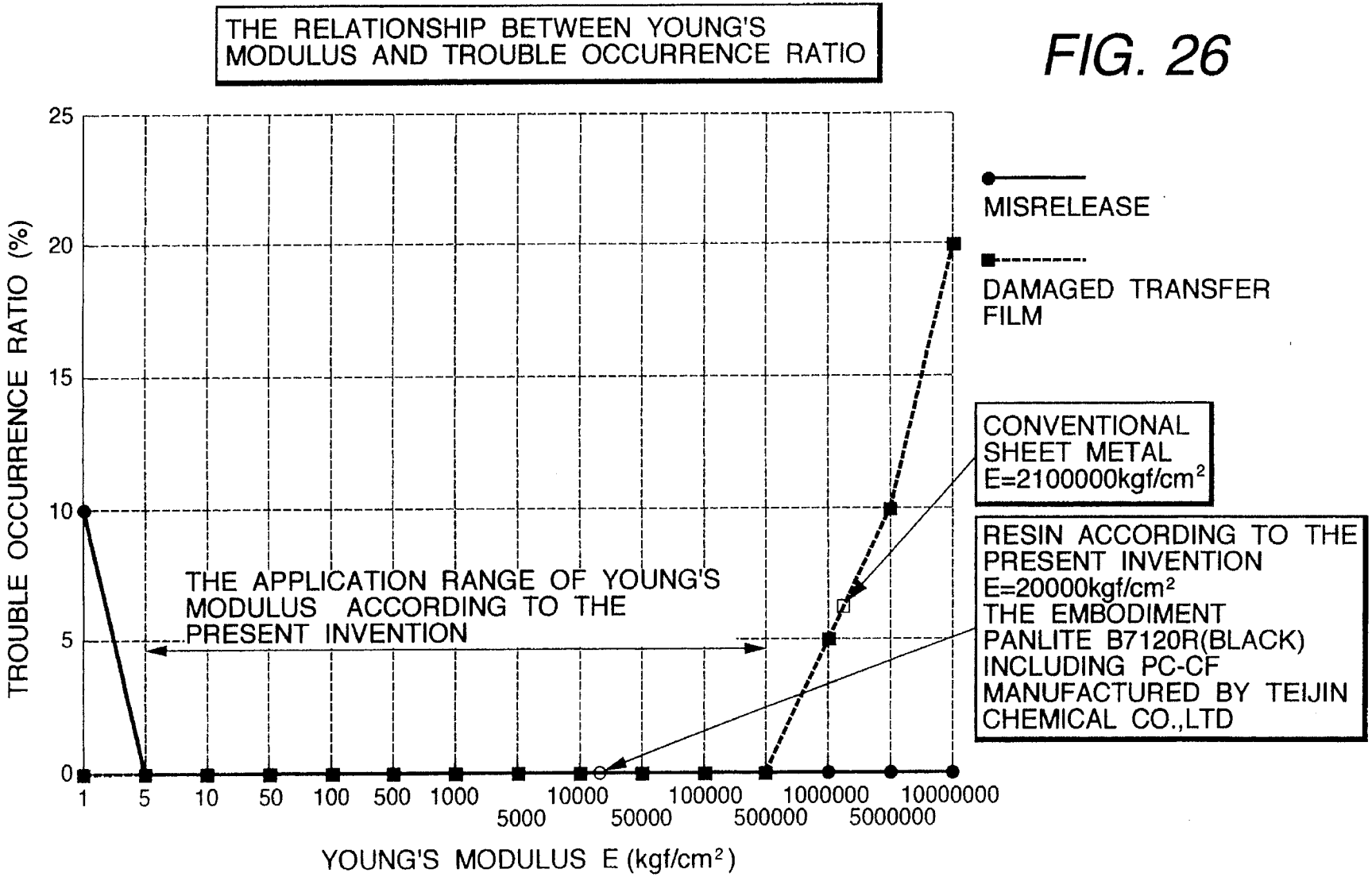
FIG. 26 is a graphic representation for indicating a relationship between the Young's modulus of the strip finger and the trouble occurrence ratio.

Also, since the Young's modulus of the strip finger is set to be higher than, or equal to 5 kgf/cm$^2$ and be lower than, or equal to 500,000 kgf/cm$^2$ in this embodiment, as confirmed by the experiments effected by the Inventors of the present invention, as illustrated in FIG. 26, there are no such risks that the stripping operation by such a pawl-shaped stripping member is insufficiently carried out due to the elastic deform as the pawl-shaped stripping member whose Young's modulus is below 5 kgf/cm$^2$, and moreover, such a pawl-shaped stripping member would stick the transfer film for constituting the transfer member carrier to thereby damage this transfer film, as the pawl-shaped stripping member whose Young's modulus exceeds 5,000,000 kgf/cm$^2$.

Additionally, in accordance with this embodiment, as represented in FIG. 2, it is so arranged that the shape of the side edge portion 50*c* of the transfer member contact surface 50*a* of the strip finger 50 is made in such a manner that the width thereof is widened in accordance with the advancing direction of the stripped transfer member 24, and also the tip portion 50*b* of the strip finger 50 is made in either the curved line shape or the straight line along the shaft direction of the transfer drum 23 to thereby form the portion 50*a* in a plane shape, which is made in contact with this strip finger 50 after the transfer member 24 has been stripped. As a consequence, even when it is so arranged that the wedge shape corresponding to the sectional shape of the strip finger 50 is made relatively thick, as shown in FIG. 1, to thereby avoid that the surface of the transfer film 42 of the transfer drum 23 is damaged by the tip portion 50*b* of the strip finger 50, the transfer member 24 can be initially and surely stripped from the transfer drum 23 by the tip portion 50*b* of the strip finger 50 made in the straight line shape, or the curved line shape along the shaft direction of the transfer drum 23. Thereafter, the width of the sick edge portion 501*c* is made wide in accordance with the advancing direction of the stripped transfer member 24, and also the transfer member 21 can be smoothly picked up from the transfer film 42 by the plane-shaped portion 50*a* of the strip finger 50, which is made in contact with the stripped transfer member 24. Thus, the transfer member 24 can be surely stripped.

Moreover, in this embodiment, since the strip finger 50 is constructed by employing the elastic member, it is possible to prevent such a problem that when this strip finger 50 is made in contact with the transfer drum 23 under excessive pressure, the tip portion 50*b* of the strip finger 50 is elastically deformed to thereby damage either the transfer drum 23, or the transfer member 24.

Figure 7B:
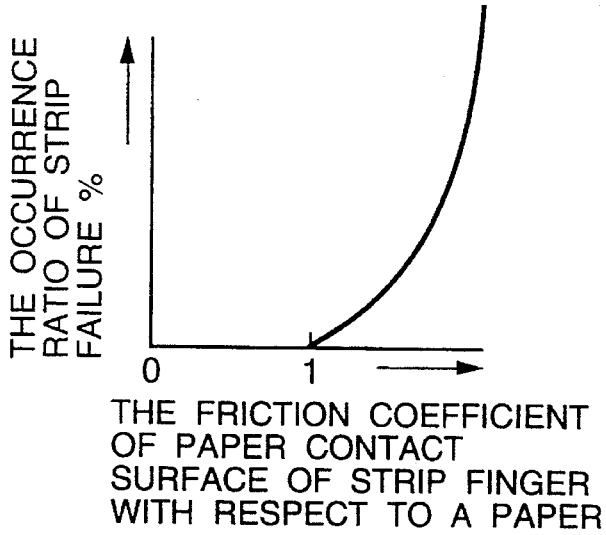

Furthermore, since this embodiment is so arranged that since the friction coefficient of the transfer member contact surface 50*a* of the strip finger 50 with respect to the transfer member 24 is set to be smaller than, or equal to 1, the tip portion of the transfer member 24 is smoothly guided by the transfer member contact surface 50*a* of the strip finger 50 having the low friction coefficient after the transfer member 24 has been stripped from the transfer drum 23. Therefore, as shown in FIG. 7B, it is possible to prevent such a problem that such a strip failure as a paper jam occurs in the tip portion of the transfer member 24.

Figure 8:
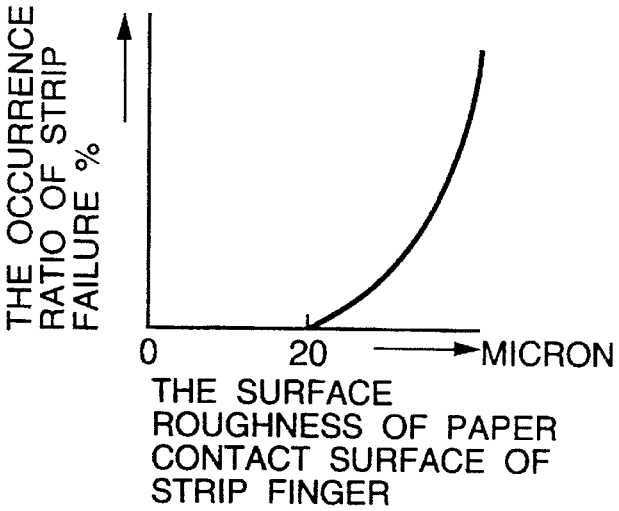
FIG. 8 is a graphic representation for showing a relationship between the surface roughness of the paper contact surface of the strip finger and the occurrence ratio of strip failure.
Figure 10:
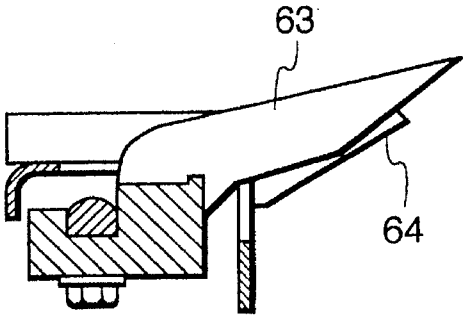
FIG. 10 is a sectional structural diagram for indicating a major portion of a stripping apparatus of an image forming apparatus according to a further embodiment of the present invention.

It should be noted that even when the surface roughness of the transfer member contact surface 50*a* of the strip finger 50 is smaller than, or equal to 20 μm, since the tip portion of the transfer member 24 is guided by the transfer member contact surface 50*a* having small surface roughness of the strip finger 50 after the transfer member 24 has been stripped from the transfer drum 23, as illustrated in FIG. 8, it is possible to avoid that the strip failure such as the paper jam occurs in the tip portion of the transfer member 24.

(EMBODIMENT 2)

Figure 9:
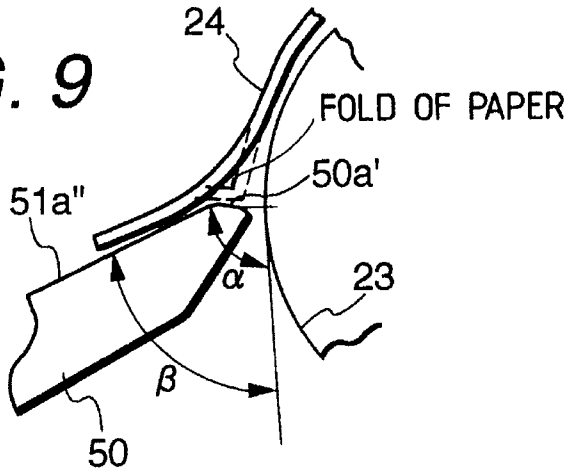
FIG. 9 is a sectional structural diagram for indicating a major portion of a stripping apparatus of an image forming apparatus according to another embodiment of the present invention.

FIG. 9 indicates an image forming apparatus according to an embodiment 2 of the present invention. The same reference numerals used in the above-explained embodiment will be employed as those for indicating the same components of this embodiment 2. According to this embodiment, the image forming apparatus is comprised of a pawl-shaped stripping member for stripping the transfer member from the transfer member carrier while being made in contact with a surface of the transfer member carrier at a predetermined timing, the pawl-shaped stripping member having a sectional view of a substantially wedge shape; a tip shape of the pawl-shaped stripping member, which is made in contact with the transfer member, is made in such a manner that a width of the tip shape is widened along with the advancing direction of the transfer member after being stripped; a tip portion of the pawl-shaped stripping member is made in a straight-line shape; and a portion of the pawl-shaped stripping member, which is made in contact with the transfer member after the transfer member has been stripped, is constructed of a first very small plane, the contact angle of which is relatively large with respect to the transfer member carrier made firstly in contact with at least a rear surface of the transfer member, and a second plane, the contact angle of which is relatively small with respect to the transfer member carrier formed subsequent to the first plane.

That is to say, in accordance with this embodiment 2, it is not so constructed that the upper edge surface 50*a* of the strip finger 50 form a single plane up to the tip portion thereof. However, as illustrated in FIG. 9, a portion of the upper edge surface 50*a* of the strip finger 50, to which the transfer member 24 contacts after being stripped, is constructed of a first very small plane 50*a*' and a second plane 50*a*". The first plane 50*a*' owns a relatively large contact angle "α" with respect to the transfer drum 23, which is firstly made in contact with the rear surface of the transfer member 24. The second plane 50*a*" owns a relatively small contact angle "B" (B<α) with respect to the transfer drum, which is formed subsequent to this first plane 50*a*'.

It should be noted that the upper edge surface 50*a* of the strip finger 50 is not arranged by two planes such as the first plane 50*a*' and the second plane 50*a*", but may be arranged by three subdivided planes.

According to the embodiment 2, the image forming apparatus is comprised of a strip finger 50 having a substantially wedge shape, which is used to strip the transfer member 24 from the transfer drum 23 and is made in contact with the surface of the transfer drum 23 at a predetermined timing. The width of the side edge portion 50*c* of the transfer member contact surface 50*a* of this strip finger 50 is made wide in accordance with the advancing direction of the stripped transfer member 24, and also, as shown in FIG. 4B or 4C, the tip portion 50*a* of the strip finger 50 is made in a straight line shape along the shaft direction of the transfer drum 23. The portion of this strip finger 50 to which the stripped transfer member 24 is contacted is constructed of the first very small plane 50*a*' and the second plane 50*a*". The first very small plane 50*a*' owns the relatively large contact angle "α" with respect to the transfer drum 23, at least which is firstly made contact with the rear surface of the transfer member 24. The second plane 50*a*" owns the relatively small contact angle "β" with respect to the transfer drum 23, which is formed subsequent to this first plane 50*a*'. As a consequence, even if such special paper 24 as a double postcard with reply card attached and a Christmas card, in which a fold is present, is employed, when the fold of this paper 24 is stripped from the transfer drum 23, the fold of the paper 24 is raised by the first very small plane 50*a*' whose contact angle is relatively large with respect to the transfer drum 23 and which first contacts with the rear surface of the transfer member 24. Also, the fold of the paper 24 is stripped from the surface of the transfer drum 23 by the second plane 50*a*" due to hardness of the paper 24. As a result, it is possible to surely prevent such a problem that the tip portions 50*b* of the strip finger 50 would stick the fold of the paper 24.

As indicated in FIG. 2, when the tip portion 50*b* of the strip finger 50 is made in an arc shape along the shaft direction of the transfer drum 23, even if such special paper 24 as a double postcard with a reply card attached and a Christmas card is employed which contains the fold, the rear surface of the fold of the paper can be smoothly stripped by the arc-shaped tip portion of the strip finger. As a consequence, the above-described first plane and second plane and the like need not be necessarily provided.

Since other structures and effects thereof are similar to those of the above-explained embodiment, the explanations thereof are omitted.

(EMBODIMENT 3)

FIGS. 10 to 13 represent an image forming apparatus according to an embodiment 3 of the present invention. It should be noted that the same reference numerals of the above-explained embodiments will be employed as those for indicating the same components of this embodiment 3. The image forming apparatus of the embodiment 3 is comprised of a strip guide member arranged at least near the pawl-shaped stripping member and along the axial direction of the transfer member carrier under non-contact condition with the surface of the transfer member carrier, for supporting the stripping effect of the pawl-shaped stripping member; and both of the transfer member contact surface of the pawl-shaped striping member and a transfer member contact surface of the strip guide member constitute the substantially same plane when the pawl-shaped stripping member is under stripping condition.

Figure 11:
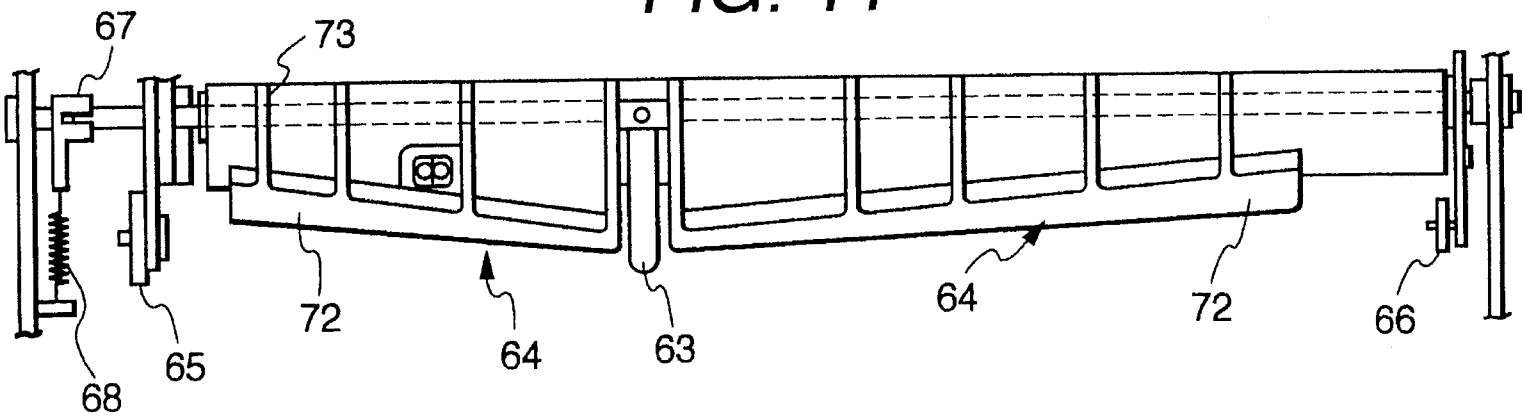
FIG. 11 is a plan view for showing the stripping apparatus according to this embodiment.
Figure 12:
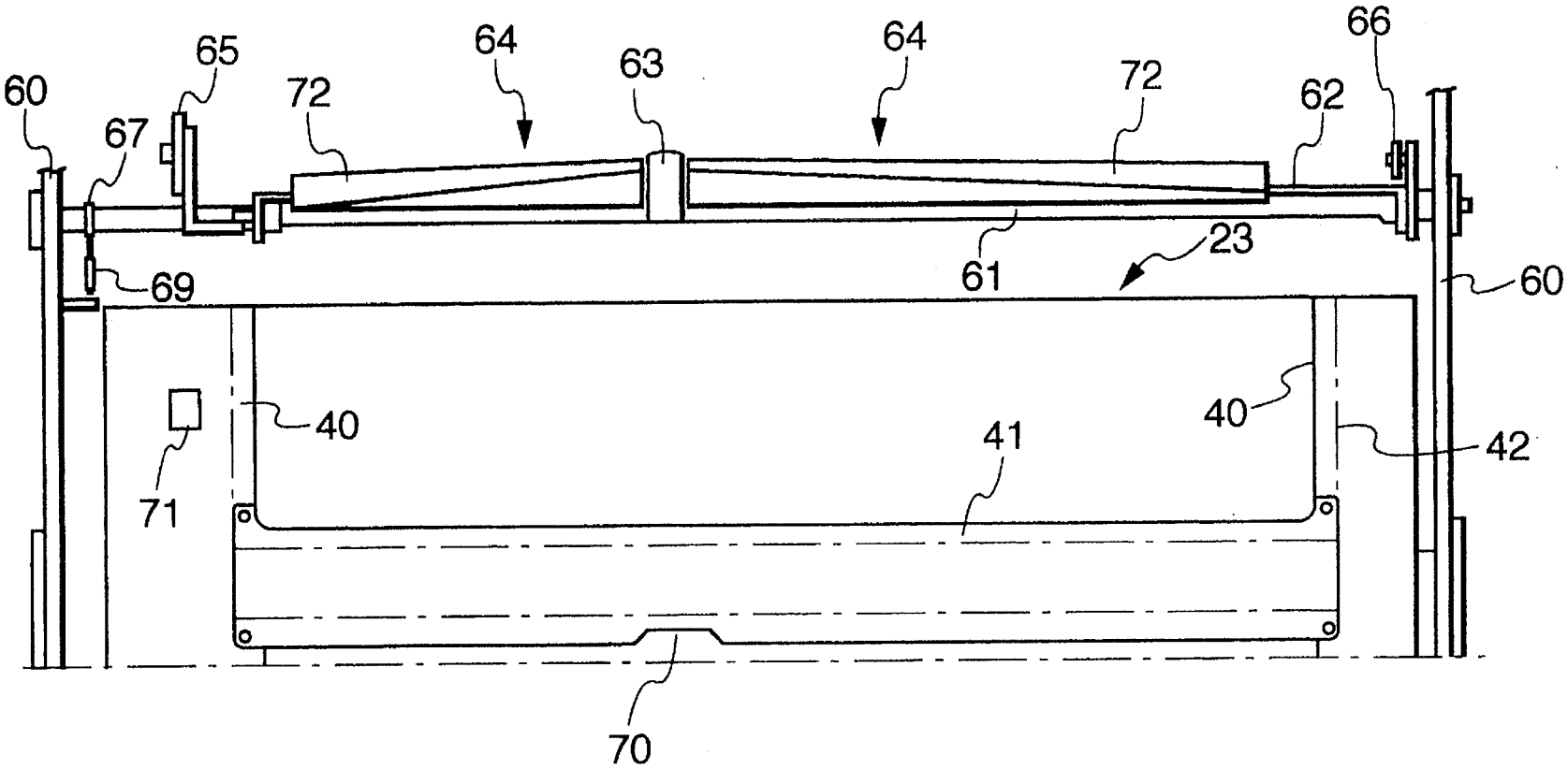
FIG. 12 is a front view for showing the stripping apparatus according to this embodiment.

That is to say, according to this embodiment 3, as shown in FIGS. 11 and 12, a stripping apparatus 44 is constructed of a pivot shaft 61 rotatably supported by a front frame 60 and a rear frame 60 of the apparatus, a supporting member 62 rotatably mounted to this pivot shaft 61, and a strip finger 63 fixed to the pivot shaft 61 at a position close to one side and from a central portion of this supporting member 62. Also, the stripping apparatus 44 is further comprised of stripping guide members 64 positioned at both ends of this strip finger 63 and fixed to the pivot shaft 61, a first guide roller 65 mounted on one end of the pivot shaft 61, and a second roller 66 mounted to the supporting member 62 at the opposite side of this first guide roller 65.

An actuation arm 67 is mounted on one end of the pivot shaft 61, and a spring 68 is provided between this actuation arm 67 and the from 60, so that the strip finger 63, the supporting member 62, and the strip guide 64 are energized in such a manner that these members are pivoted toward the front side as viewed in FIG. 12. A solenoid 69 is provided between the actuation arm 67 and the frame 60, so that both of the strip finger 63 and the strip guide member 64 are pivoted toward the front side, as viewed in FIG. 12. Also, the supporting member 62 and the strip guide member 64 are energized in such a manner that these members are pivotable toward the front side, as viewed in FIG. 12. It should be noted that both of the supporting member 62 and the strip guide member 64 may be driven by another solenoid. With the above-described structure, both of the supporting member 62 and the strip guide member 64 are pivotable irrelevant to the strip finger 63.

On the other hand, a clearance groove 70 is formed in a tie-bar plate 41 of the transfer drum 23 and located opposite to the strip finger 63, whereas a guide groove 71 into which the first guide roller 65 is inserted is formed in a ring member 40.

Figure 13:
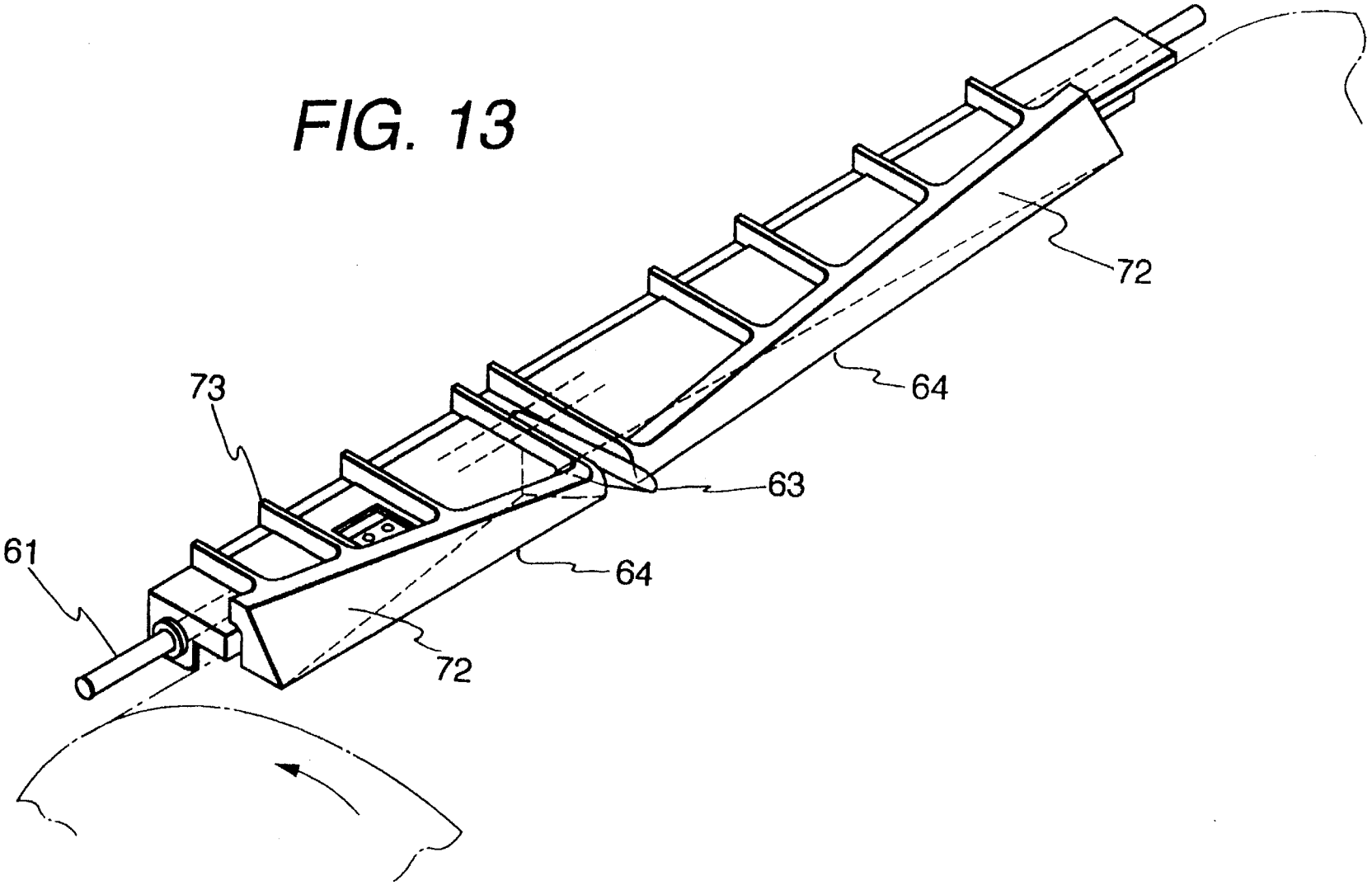
FIG. 13 is a perspective view for showing the stripping apparatus according to this embodiment.

As shown in FIG. 11, the strip guide member 64 is so constructed that an inclined surface 72 is formed on the front surface in an integral form, a rib 73 is provided backwardly, and the inclined surface 72 is fabricated in such a way that this inclined surface 72 is returned backwardly while being separated from the strip finger 63. As shown in FIG. 13, the inclined surface 72 is formed in such a manner that the height of this inclined surface 72 is lowered while being separated from the strip finger 63.

Furthermore, according to this embodiment, as illustrated in FIG. 14C and FIGS. 15 to 18, both of a transfer member contact surface 63a of the strip finger 63, and another transfer member contact surface 64a of the strip guide member 64 are set in such a manner that this strip finger 63 forms the substantially same plane with them under strip condition.

In the case that a chargeable material such as plastic is employed as the material of the strip guide member 64, this material is charged by the friction effects with the transfer member 24 and the strip guide member 64, and also the corona charger to newly produce electrostatic adsorption force between the transfer member 24 and this guide member 64. This may impede the transportation of the transfer member 24 and may cause the images to be disturbed. Then, as the strip guide member 64, for instance, such conductive resin, metal, and metal plating materials are employed, the surface resistance values of which are uniform and lower then, or equal to $10^3$ Ωcm. Also, a front surface of the strip guide member 64 is made of the inclined surface 72 in an integral form, so that the edge portion in which the gaseous discharge and the corona discharge for charge exfoliation are concentrated can be reduced as small as possible. It is also possible to prevent the image from being disturbed under low humidity by relaxing the gaseous discharge. Moreover, because it is no longer necessary to reduce the gaseous discharge, a pair of toner charge exfoliating devices need not be used, as they may further reduce the gaseous discharge, as well as the electrostatic adsorption force.

Figure 14A:
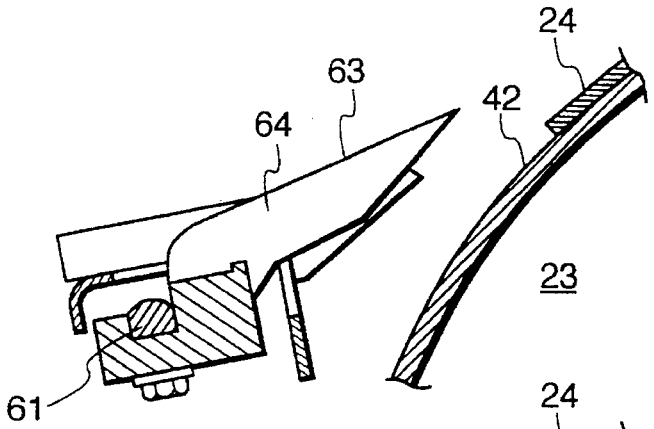
FIGS. 14A to 14C are sectional structural diagrams for representing operations of the strip finger.
Figure 14B:
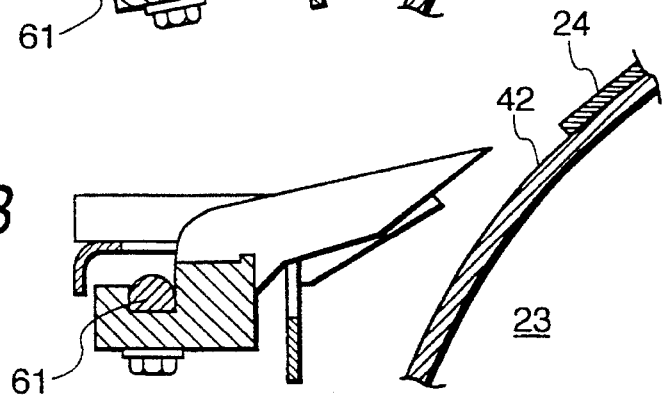
Figure 14C:
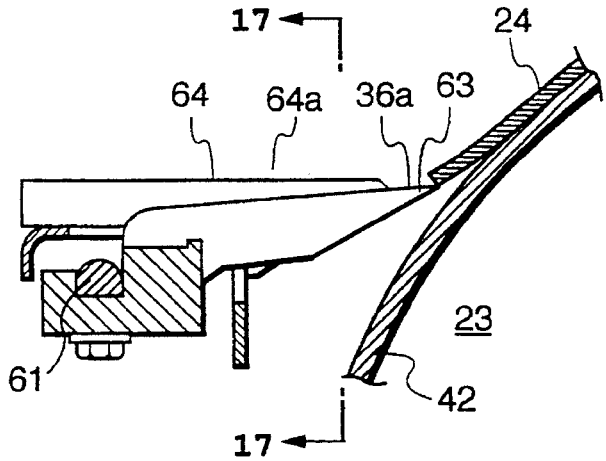
Figure 15:
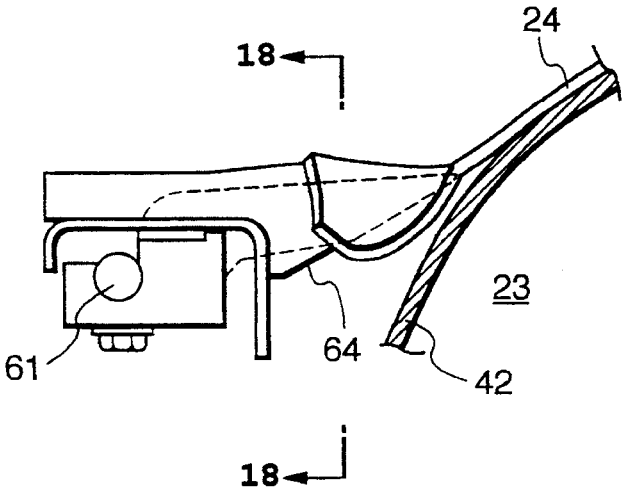
FIG. 15 is a sectional structural diagram for indicating operations of the strip finger.
Figure 16:
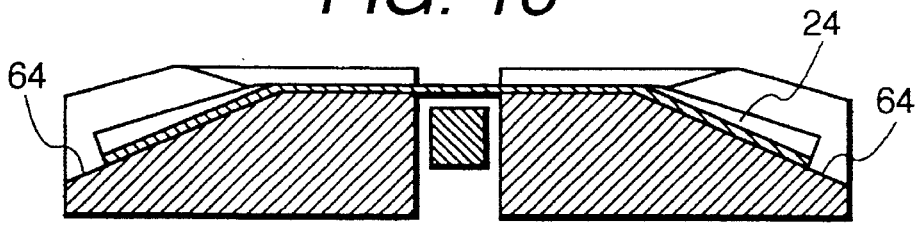
FIG. 16 is a sectional structural diagram for indicating operations of the strip finger.
Figure 17:
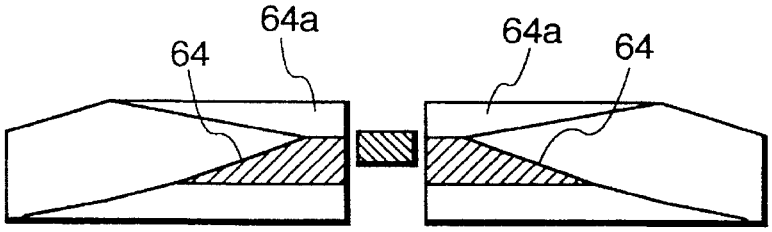
FIG. 17 is a sectional structural diagram for indicating operations of the strip finger.
Figure 18:
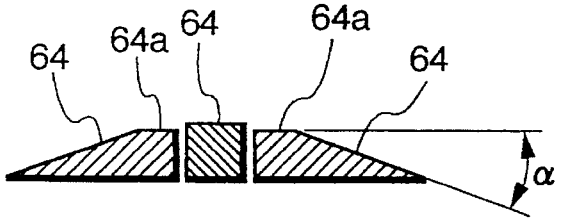
FIG. 18 is a sectional structural diagram for indicating operations of the strip finger.
Figure 19:
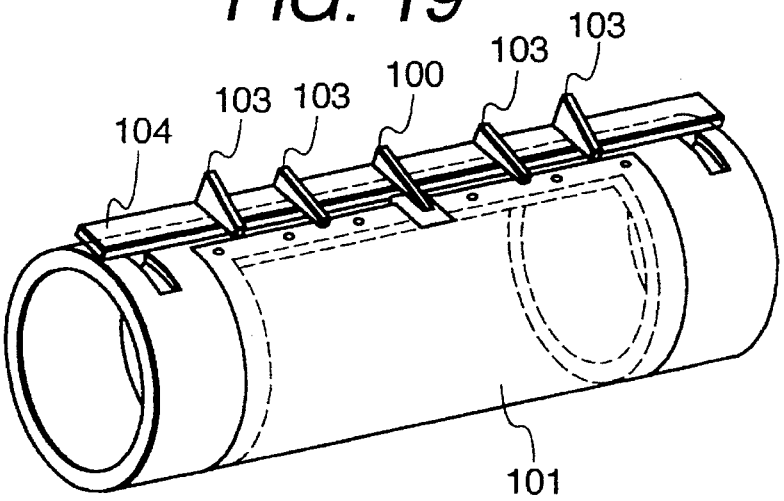
FIG. 19 is a perspective view for showing the stripping apparatus employed in the conventional image forming apparatus.
Figure 20A:
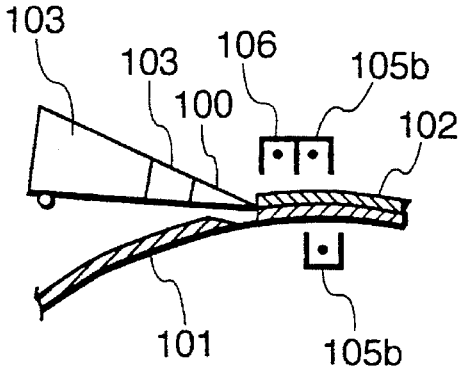
FIGS. 20A and 20B are sectional structural diagrams for indicating the effects of the stripping apparatus.
Figure 20B:
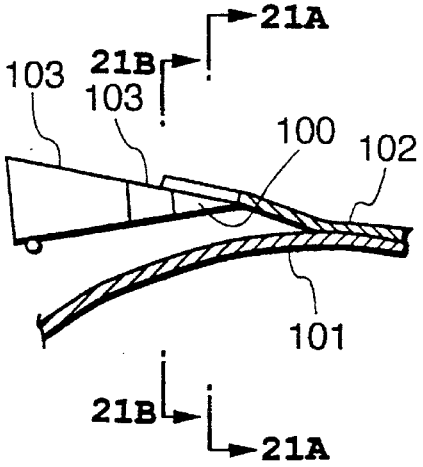
Figure 21A:
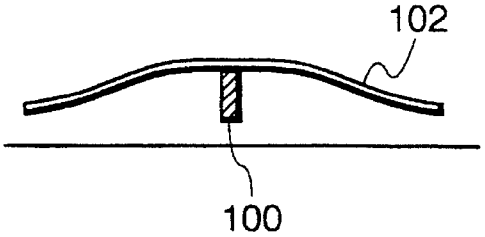
FIGS. 21A and 21B are sectional structural diagrams for indicating the effects of the stripping apparatus.
Figure 21B:
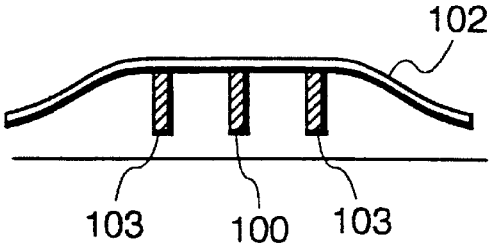
Figure 22A:
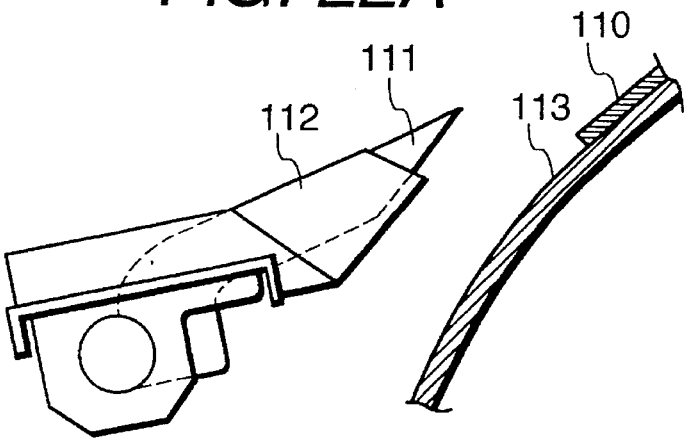
FIGS. 22A to 22C are sectional structural diagrams for representing operations of the stripping apparatus employed in the conventional image forming apparatus.
Figure 22B:
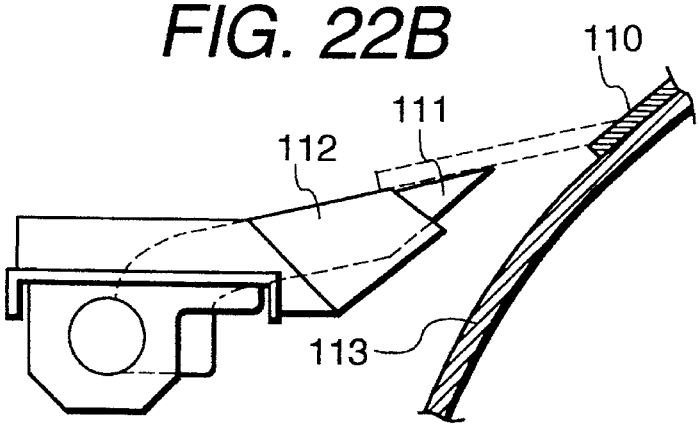
Figure 22C:
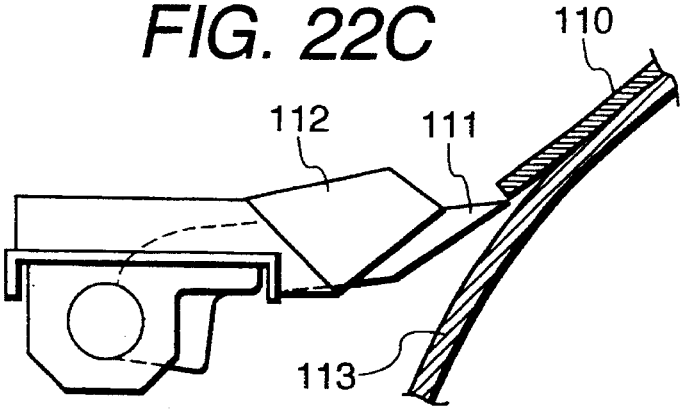
Figure 23:
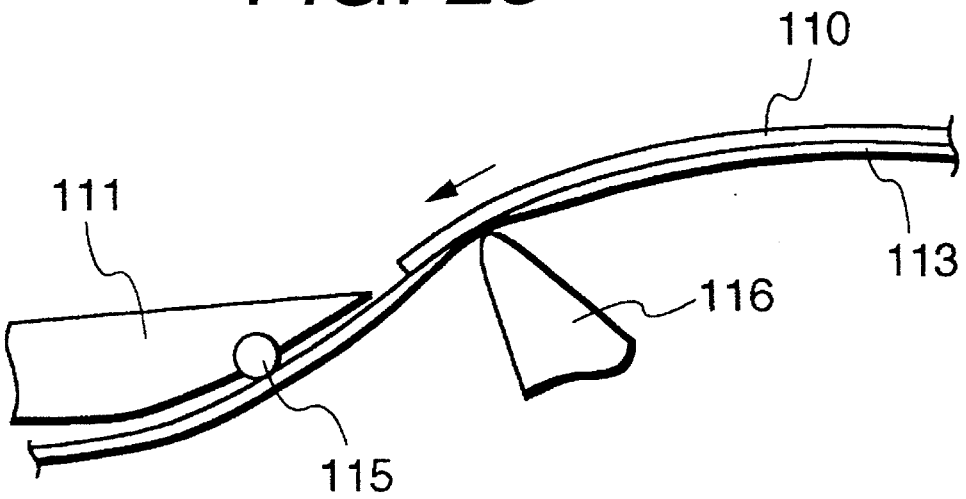
FIG. 23 is a sectional structural diagram for showing another stripping apparatus employed in the conventional image forming apparatus.
Figure 24:
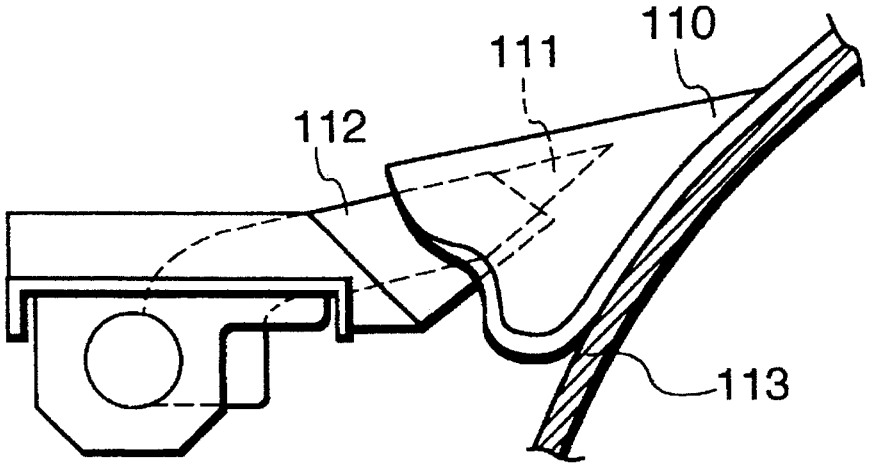
FIG. 24 is a sectional structural diagram for indicating the effect of the conventional stripping apparatus.

In accordance with the image forming apparatus with the above-described arrangement of this embodiment, the pivot shaft 61 is pivoted by means of the spring elastic force, and then the strip finger 63, supporting member 62, and strip guide member 64 of the stripping apparatus 44 are located apart from the transfer drum 23, as shown in FIG. 14A, under the transfer operation. When the transfer operation is complete and then the transfer member 24 is stripped, the solenoid 69 is driven and the pivot shaft 61 pivots the strip finger 63, the supporting member 62, and the strip guide member 64 in a direction along which these members approach the transfer drum 23. Then, the second guide roller 66 abuts against the ring member 40 of the transfer drum 23 and is brought to such a waiting position as shown in FIG. 14B. Furthermore, when the transfer drum 23 is rotated, the first guide roller 65 is inserted into the guide groove 71 formed in the ring member 40. As a result, as shown in FIG. 14C, only the strip finger 63 is pivoted under such a condition that the strip guide member 64 is stopped, the tip of the strip finger 63 picks up the tip of the transfer member 24, and then the transfer member 24 is separated from the transfer film 43. When the transfer member 24 is separated by the strip finger 63, immediately after, the strip finger 63 is returned to the waiting position of FIG. 14B. At this time, since the strip guide member 64 is not pivoted, the tip portion can be brought close to the transfer drum 23 as closely as possible, so that the better stripping performance can be obtained. After the transfer member 24 has passed, the strip finger 63 is returned to the position of FIG. 14A by way of the solenoid 69, and in synchronism therewith, the strip guide member 64 is also separated from the transfer drum 23.

Also, in accordance with this embodiment, the strip guide member 64 is provided which is located near the strip finger 63 under non-contact condition with the surface of the transfer drum 23, and also arranged along the shaft direction of this transfer drum 23, and also which may support the stripping effects by the strip finger 63. As illustrated in FIG. 14C and FIG. 15 to FIG. 18, since both of the transfer member contact surface 63*a* of the strip finger 63 and the transfer member contact surface 64*a* of the strip finger 64 are set so as to constitute the substantially same plane under such a condition that this strip finger 63 is under stripping state, after the transfer member 24 is stripped from the transfer drum 23, the transfer member is smoothly guided by both of the transfer member contact surface 63*a* of the strip finger 63 and the transfer member contact surface 64*a* of the strip guide member 64*a*, which constitute the substantially same plane. Therefore, it is possible to prevent such a problem that the strip failure such as a paper jam occurs at the tip of the transfer member 24.

This invention has been made with the above-described arrangements and effects. In the image forming apparatus according to aspect 1 of the present invention, since the image forming apparatus comprises a pawl-shaped stripping member for stripping the transfer member from the transfer member carrier while being made in contact with a surface of the transfer member carrier at a predetermined timing; the volume electric resistance value of at least a portion of the pawl-shaped stripping member, which is made in contact with the transfer member, is selected to be smaller than, or equal to $10^7$ Ω.cm; otherwise the surface electric resistance value thereof is selected to be smaller than, or equal to $10^7$ Ω/cm, even if at least the portion of the pawl-shaped stripping member, which is made in contact with the transfer member, is made of an insulating material, the resistance value is relatively small. Thus, when the transfer member is stripped from the surface of the transfer member carrier by way of the pawl-shaped stripping member, it is possible to avoid, or suppress such a fact that the stripping discharge is produced from the transfer member toward the pawl-shaped stripping member. Even when the charging amounts of the transfer member are large under low temperature/low humidity condition, and the second copy surface of the double-surface copy paper, it is possible to avoid that the image defect is caused by the stripping discharge.

Moreover, in this image forming apparatus according to aspect 1 of the present invention, since the volume electric resistance value of at least a portion of the pawl-shaped stripping member, which is made in contact with the transfer member, is selected to be greater than, or equal to 10 Ω.cm, otherwise the surface electric resistance value thereof is selected to be greater than, or equal to 10 Ω/cm, even when the transfer member is such paper containing higher humidity under high temperature/high humidity environments, it is possible to avoid such a fact that the transfer current is leaked through the transfer member constructed of the paper containing the high humidity whose resistance becomes low to the pawl-shaped stripping member, resulting in insufficient transfer operation. This transfer current is used to transfer the toner image from the image carrier to the transfer member held on the transfer member carrier.

In the image forming apparatus according to aspect 2 of the present invention, since the image forming apparatus comprises a pawl-shaped stripping member for stripping the transfer member from the transfer member carrier while being made in contact with a surface of the transfer member carrier at a predetermined timing; and Young's modulus of the pawl-shaped stripping member is selected to be greater than, or equal to 5 kgf/cm$^2$, and smaller than, or equal to 500,000 kgf/cm$^2$, there is no such an insufficient transfer operation caused by deformation of the pawl-shaped stripping member as the pawl-shaped stripping member whose Young's modulus is below 5 kgf/cm$^2$. Moreover, there is no risk that such a pawl-shaped stripping member whose Young's modulus exceeds 500,000 kgf/cm$^2$sticks the transfer film for constituting the transfer member carrier to thereby damage this transfer film.

Also, in the image forming apparatus according to aspect 3 of the present invention, the image forming apparatus comprises a pawl-shaped stripping member for stripping the transfer member from the transfer member carrier while being made in contact with a surface of the transfer member carrier at a predetermined timing, the pawl-shaped stripping member having a sectional view of a substantially wedge shape; the tip shape of the pawl-shaped stripping member, which is made in contact with the transfer member, is made in such a manner that a width of the tip shape is widened along with the advancing direction of the transfer member after being stripped; the tip portion of the pawl-shaped stripping member is made in a straight-line shape or a curved-line shape along the axial direction of the transfer member carrier; and the portion of the pawl-shaped stripping member, which is made in contact with the surface of the transfer member carrier after the transfer member has been stripped, is made in a plane shape. Accordingly, even when the image forming apparatus is so arranged that the substantially wedge shape corresponding to the sectional view of the pawl-shaped stripping member is made thick in order to prevent the surface of the transfer member carrier from being damaged by the tip portion of the pawl-shaped stripping member, the transfer member can be firmly stripped at the initial stage by the tip portion of the pawl-shaped stripping member formed in either the straight-line shape, or the curved-line shape along the axial direction of the transfer member carrier. Thereafter, the width of the pawl-shaped stripping member is made wide along the advancing direction of the stripped transfer member, and also the transfer member is smoothly picked up from the transfer member carrier by the plane-shaped portion of the pawl-shaped stripping member which is made in contact with the transfer member after being stripped. Therefore, the transfer member can be firmly stripped.

In addition, in the image forming apparatus according to aspect 4 of the present invention, the image forming apparatus comprises a pawl-shaped stripping member for stripping the transfer member from the transfer member carrier while being made in contact with a surface of the transfer member carrier at a predetermined timing, the pawl-shaped stripping member having a sectional view of a substantially wedge shape; the tip shape of the pawl-shaped stripping member, which is made in contact with the transfer member, is made in such a manner that a width of the tip shape is widened along with the advancing direction of the transfer member after being stripped; the tip portion of the pawl-shaped stripping member is made in a straight-line shape; and a portion of the pawl-shaped stripping member, which is made in contact with the transfer member after the transfer member has been stripped, is constructed of the first very small plane, the contact angle of which is relatively large with respect to the transfer member carrier made firstly in contact with at least the rear surface of the transfer member, and the second plane, the contact angle of which is relatively small with respect to the transfer member carrier formed subsequent to the first plane. Even if such a special paper as a double postcard with a reply card attached and a Christmas card, in which a fold is present, is employed, when the fold of this special paper is stripped from the transfer member carrier, the fold of the special paper is raised by the first very small plane whose contact angle is relatively large with respect to the transfer member carrier which is firstly made in contact with the rear surface of the transfer member. Thus, since the fold of the special paper is stripped from the surface of the transfer member carrier at the second plane by way of the hardness of the paper, it is surely possible to avoid such a fact that the tip portion of the pawl-shaped stripping member sticks the fold of the paper.

Furthermore, the image forming apparatus according to aspect 5 of the present invention is so arranged by that in the image forming apparatus in any one of aspects 1 and 4, the friction coefficient of the transfer member contact surface of the pawl-shaped stripping member with respect to the transfer member is selected to be smaller than, or equal to 1. Since after the transfer member has been stripped from the transfer member carrier, the tip portion of the transfer member is guided by the transfer member contact surface of the pawl-shaped stripping member having the low friction coefficient, it is possible to prevent the occupance of the paper jam at the tip portion of the transfer member.

Moreover, the image forming apparatus according to aspect 6 of the present invention is so arranged by that in the image forming apparatus in any one of the aspects 1 to 4, the surface roughness of the transfer member contact surface of the pawl-shaped stripping member is selected to be lower than, or equal to 20 μm. Since after the transfer member has been stripped from the transfer member carrier, the tip portion of the transfer member is guided by the transfer member contact surface of the pawl-shaped stripping member whose surface roughness is low, it is possible to prevent the occurrence of the paper jam at the tip portion of the transfer member.

Also, in the image forming apparatus according to aspect 7 of the present invention is so arranged by that in the image forming apparatus in any one of the aspects 1 to 6, the image forming apparatus comprises a strip guide member arranged at least near the pawl-shaped stripping member and along the axial direction of the transfer member carrier under non-contact condition with the surface of the transfer member carrier, for supporting the stripping effect of the pawl-shaped stripping member; and both of the transfer member contact surface of the pawl-shaped striping member and a transfer member contact surface of the strip guide member constitute the substantially same plane when the pawl-shaped stripping member is under stripping condition. As a consequence, after the transfer member has been stripped from the transfer member carrier, the substantially same plane thereof is guided by the transfer member contact surface of the pawl-shaped stripping member and the transfer member contact surface of the stripping guide member, so that it is possible to prevent the occurrence of the paper jam at the tip portion of the transfer member.

What is claimed is:

1. An image forming apparatus, comprising:

an image carrier on which a plurality of toner images having different colors from each other are successively formed;

a transfer member to which said plurality of toner images formed on said image carrier are transferred;

a transfer member carrier on which said transfer member is carried in such a condition that said plural toner images are successively overlapped with each other to thereby form an image; and a pawl-shaped stripping member for stripping said transfer member from said transfer member carrier while being made in contact with a surface of said transfer member carrier at a predetermined timing; wherein a volume electric resistance value of at least a portion of said pawl-shaped stripping member, which is made in contact with the transfer member, is selected to be greater than, or equal to 10 Ω.cm, and smaller than, or equal to $10^7$ Ω.cm; otherwise a surface electric resistance value thereof is selected to be greater than, or equal to 10 Ω/cm, or smaller than, or equal to $10^7$ /cm.

2. The image forming apparatus of claim 1, wherein:

a friction coefficient of said transfer member contact surface of said pawl-shaped stripping member with respect to said transfer member is selected to be smaller than, or equal to 1.

3. The image forming apparatus of claim 1, wherein:

a surface roughness of said transfer member contact surface of said pawl-shaped stripping member is selected to be lower than, or equal to 20 μm.

4. An image forming apparatus, comprising:

an image carrier on which a plurality of toner images having different colors from each other are successively formed;

a transfer member to which said plurality of toner images formed on said image carrier are transferred;

a transfer member carrier on which said transfer member is carried in such a condition that said plural toner images are successively overlapped with each other to thereby form an image; and a pawl-shaped stripping member for stripping said transfer member from said transfer member carrier while being made in contact with a surface of said transfer member carrier at a predetermined timing; wherein Young's modulus of said pawl-shaped stripping member is selected to be greater than, or equal to 5 $kgf/cm^2$, and smaller than, or equal to 500,000 $kgf/cm^2$.

5. The image forming apparatus of claim 4, wherein:

a friction coefficient of said transfer member contact surface of said pawl-shaped stripping member with respect to said transfer member is selected to be smaller than, or equal to 1.

6. The image forming apparatus of claim 4, wherein:

a surface roughness of said transfer member contact surface of said pawl-shaped stripping member is selected to be lower than, or equal to 20 μm.

7. An image forming apparatus, comprising;

an image carrier on which a plurality of toner images having different colors from each other are successively formed;

a transfer member to which said plurality of toner images formed on said image carrier are transferred;

a transfer member carrier on which said transfer member is carried in such a condition that said plural toner images are successively overlapped with each other to thereby form an image; and a pawl-shaped stripping member for stripping said transfer member from said transfer member carrier while being made in contact with a surface of said transfer member carrier at a predetermined timing, wherein said pawl-shaped stripping member has a sectional view of a substantially wedge shape;

a tip shape of said pawl-shaped stripping member, which is made in contact with said transfer member, is made in such a manner that a width of said tip shape is widened along with the advancing direction of said transfer member after being stripped;

a tip portion of said pawl-shaped stripping member is made in a straight-line shape or a curved-line shape along the axial direction of said transfer member carrier; and a portion of said pawl-shaped stripping member, which is made in contact with the surface of said transfer member carrier after said transfer member has been stripped, is made in a plane shape.

8. The image forming apparatus of claim 7, wherein:

a friction coefficient of said transfer member contact surface of said pawl-shaped stripping member with respect to said transfer member is selected to be smaller than, or equal to 1.

9. The image forming apparatus of claim 7, wherein:

a surface roughness of said transfer member contact surface of said pawl-shaped stripping member is selected to be lower than, or equal to 20 μm.

10. An image forming apparatus, comprising:

an image carrier on which a plurality of toner images having different colors from each other are successively formed;

a transfer member to which said plurality of toner images formed on said image carrier are transferred;

a transfer member carrier on which said transfer member is carried in such a condition that said plural toner images are successively overlapped with each other to thereby form an image; and a pawl-shaped stripping member for stripping said transfer member from said transfer member carrier while being made in contact with a surface of said transfer member carrier at a predetermined timing, wherein said pawl-shaped stripping member has a sectional view of a substantially wedge shape;

a tip shape of said pawl-shaped stripping member, which is made in contact with said transfer member, is made in such a manner that a width of said tip shape is widened along with the advancing direction of said transfer member after being stripped;

a tip portion of said pawl-shaped stripping member is made in a straight-line shape; and a portion of said pawl-shaped stripping member, which is made in contact with said transfer member after said transfer member has been stripped; includes a first very small plane, the contact angle of which is relatively large with respect to said transfer member carrier made firstly in contact with at least a rear surface of said transfer member, and a second plane, the contact angle of which is relatively small with respect to said transfer member carrier formed subsequent to said first plane.

11. The image forming apparatus of claim 10, wherein:

a friction coefficient of said transfer member contact surface of said pawl-shaped stripping member with respect to said transfer member is selected to be smaller than, or equal to 1.

12. The image forming apparatus of claim 10, wherein:

a surface roughness of said transfer member contact surface of said pawl-shaped stripping member is selected to be lower than, or equal to 20 μm.

13. The image forming apparatus of claim 1, further comprising:

a strip guide member arranged at least near said pawl-shaped stripping member and along the axial direction of said transfer member carrier under non-contact condition with the surface of said transfer member carrier, for supporting the stripping effect of said pawl-shaped stripping member; wherein both of a transfer member contact surface of said pawl-shaped striping member and a transfer member contact surface of said strip guide member constitute a substantially same plane when said pawl-shaped stripping member is under stripping condition.

* * * * *